US011833836B2

(12) United States Patent
Soya et al.

(10) Patent No.: US 11,833,836 B2
(45) Date of Patent: Dec. 5, 2023

(54) PRINTING APPARATUS

(71) Applicant: CANON KABUSHIKI KAISHA, Tokyo (JP)

(72) Inventors: Kenji Soya, Kanagawa (JP); Shingo Horita, Kanagawa (JP); Atsushi Miyahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 17/670,433

(22) Filed: Feb. 12, 2022

(65) Prior Publication Data

US 2022/0258485 A1 Aug. 18, 2022

(30) Foreign Application Priority Data

Feb. 12, 2021 (JP) ..... 2021-020361

(51) Int. Cl.
*B41J 2/175* (2006.01)

(52) U.S. Cl.
CPC ..... *B41J 2/17596* (2013.01); *B41J 2/17506* (2013.01); *B41J 2/17509* (2013.01)

(58) Field of Classification Search
CPC ..... B41J 2/1714; B41J 2/175; B41J 2/17503; B41J 2/17506; B41J 2/17509; B41J 2/17596; B41J 29/02; B41J 29/13; B41J 9/306
See application file for complete search history.

(56) References Cited

U.S. PATENT DOCUMENTS

| | | | | |
|---|---|---|---|---|
| 6,234,616 | B1 | 5/2001 | Komuro | 347/85 |
| 6,705,712 | B2 * | 3/2004 | Usui | B41J 2/16508 347/85 |
| 7,654,656 | B2 * | 2/2010 | Umeda | B41J 2/17509 347/85 |
| 9,090,083 | B2 * | 7/2015 | Tsuji | B41J 2/175 |
| 10,843,481 | B2 | 11/2020 | Shimoyama et al. | B41J 2/17596 |

FOREIGN PATENT DOCUMENTS

| | | |
|---|---|---|
| JP | H11-70668 | 3/1999 |
| JP | 2006-248132 | 9/2006 |
| JP | 2015-027741 | 2/2015 |

OTHER PUBLICATIONS

U.S. Appl. No. 17/670,434, filed Feb. 12, 2022.
U.S. Appl. No. 17/670,435, filed Feb. 12, 2022.

* cited by examiner

*Primary Examiner* — Anh T Vo
(74) *Attorney, Agent, or Firm* — Venable LLP

(57) ABSTRACT

A printing apparatus includes: a tube configured to form a flow channel to supply a liquid to a liquid ejecting unit configured to eject the liquid; a holding unit configured to hold the tube; and a valve unit configured to move to a closed position to press and close the tube held by the holding unit with a pressing portion from an open position to open the tube held by the holding unit, and to move to the open position from the closed position. Here, the valve unit includes a pivot shaft and moves pivotally around the shaft to move to the closed position and the open position, and a direction of extension of the pivot shaft is a direction intersecting with a direction of extension of the tube held by the holding unit.

16 Claims, 13 Drawing Sheets

PRINTING APPARATUS

BACKGROUND OF THE INVENTION

Field of the Invention

The present invention relates to a printing apparatus.

Description of the Related Art

There has been known a printing apparatus configured to use a tube to connect a print head for ejecting an ink to an ink tank containing the ink to be supplied to the print head. Japanese Patent Laid-Open No. 2015-27741 (Reference 1) discloses an on-off valve which can close a tube between a print head and an ink tank by using a pressing member that is linearly driven to press the tube.

According to the printing apparatus disclosed in Reference 1, the tube pressing member may fail to apply a pressure in parallel to each tube in a case of pressing a tube having a large diameter or in a case of integrally pressing two or more tubes. As a consequence, the tube pressing member or a tube supporting member for supporting the tube may be inclined relative to a width direction of the tube, thus causing a leakage due to a failure to fully press the tube.

SUMMARY OF THE INVENTION

A printing apparatus according to an aspect of the present invention includes: a tube configured to form a flow channel to supply a liquid to a liquid ejecting unit configured to eject the liquid; a holding unit configured to hold the tube; and a valve unit configured to move to a closed position to press and close the tube held by the holding unit with a pressing portion from an open position to open the tube held by the holding unit, and to move to the open position from the closed position. Here, the valve unit includes a pivot shaft and moves pivotally around the pivot shaft to move to the closed position and the open position, and a direction of extension of the pivot shaft is a direction intersecting with a direction of extension of the tube held by the holding unit.

Further features of the present invention will become apparent from the following description of exemplary embodiments with reference to the attached drawings.

DESCRIPTION OF THE EMBODIMENTS

Embodiments of the present invention will be described below with reference to the drawings. It is to be noted that the following embodiments do not intend to limit the scope of the present invention and that all the combinations of the features described in the embodiments are not always essential. The same constituents in the embodiments will be denoted by the same reference signs in the following description.

In the present specification, the term "printing" (which may also be referred to as "print") is not limited to a case of forming significant information such as characters and graphics, but encompasses formation of all significant and insignificant information. This term is also assumed to broadly include formation of images, figures, patterns, and the like on a print medium as well as processing of a print medium regardless of whether or not these objects are materialized so as to be discernible to human eyes.

Meanwhile, the term "ink" (which may also be referred to as "liquid") should also be interpreted in a broad sense as with the definition of the "printing" mentioned above. Accordingly, this term is assumed to represent a liquid which serves to form images, figures, patterns, and the like, to process a print medium, and to modify an ink (such as coagulation and insolubilization of a colorant contained in the ink to be applied to the print medium) in the case where the liquid is applied onto the print medium.

In addition, the term "print medium" not only includes paper used in general printing apparatuses but also broadly includes media that can accept the ink as typified by cloth, plastic films, metal plates, glass, ceramics, wood, leather, and the like.

First Embodiment

<Configuration of Printing Apparatus>

Figure 1:
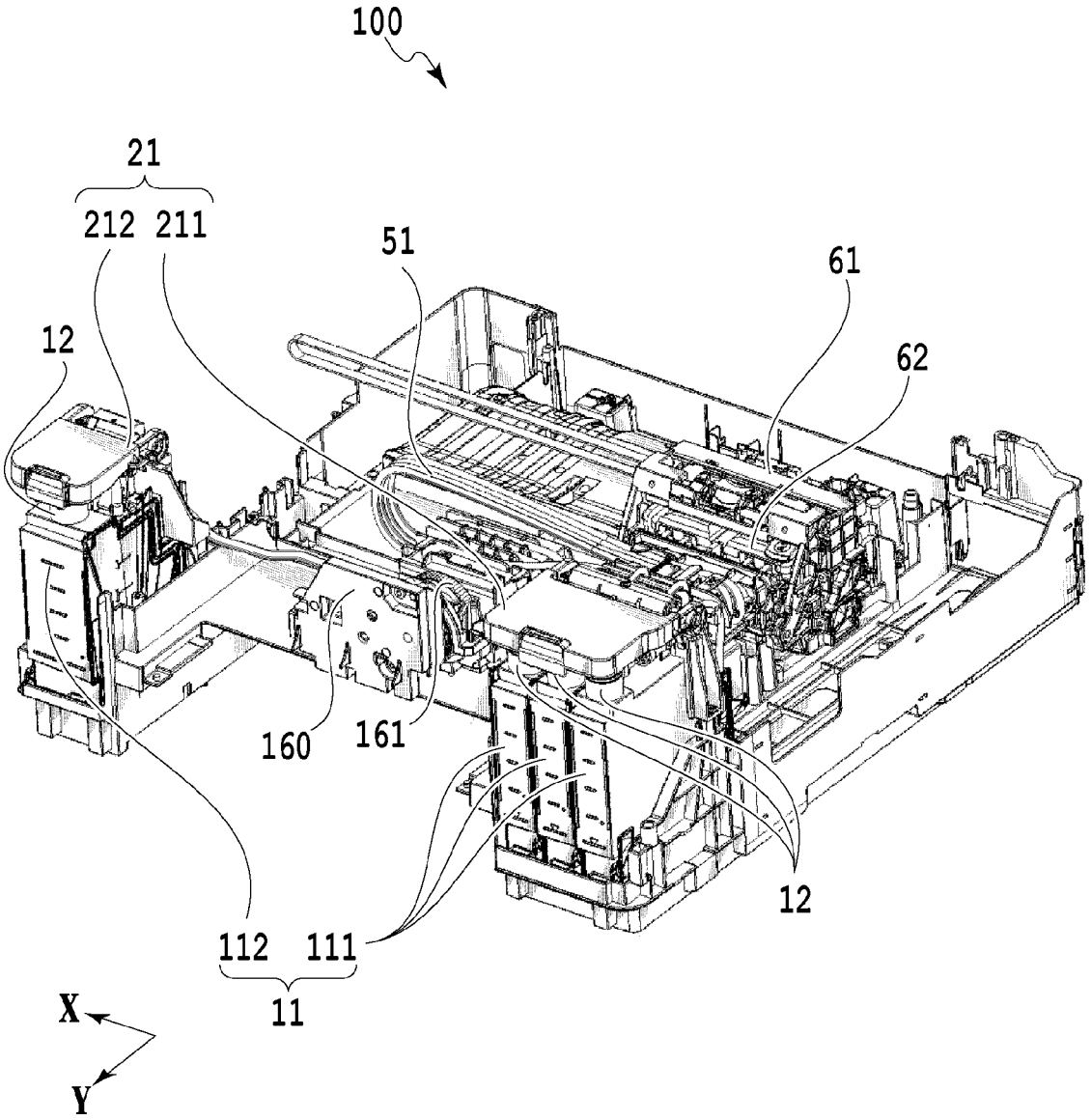
FIG. 1 is a perspective view showing a printing apparatus.

FIG. 1 is a perspective view showing a printing apparatus 100 that represents an example of a liquid ejecting apparatus of the present embodiment. FIG. 1 shows a partial configuration of the printing apparatus 100. The printing apparatus 100 includes ink tanks 11 that contain inks, a print head 62 that ejects the inks supplied from the ink tanks 11 through ink supply channels 51, and a carriage 61 that holds the print head 62. The carriage 61 is configured to scan a print medium (not shown) in a direction orthogonal to a direction of transportation of the print medium, and an image is printed on the print medium by a combination of scanning by the carriage 61 and ejection from the print head 62.

Although the present embodiment describes an example of the printing apparatus, the same applies to a case of a liquid ejecting apparatus. For example, such a liquid ejecting apparatus may include a liquid container that contains a liquid, a liquid ejecting unit that ejects the liquid supplied from the liquid container through a liquid supply channel, and a liquid ejecting unit holder that holds the liquid ejecting unit. The description will be given in the present embodiment by using the printing apparatus 100 as the example of the liquid ejecting apparatus.

Each ink tank 11 may be a first ink tank 111 or a second ink tank 112. The present embodiment shows the case of providing the multiple first ink tanks 111 on the assumption of a case of using multiple types of inks. However, in the case of using a single type of the ink, a single ink tank (such as the first ink tank 111) may only be provided. Meanwhile, the second ink tank 112 having a larger capacity than that of the first ink tank 111 may be provided in the case of using a large amount of the ink. Without limitations to the foregoing, only the second ink tanks 112 may be provided or the first ink tanks 111 and the second ink tank 112 may be provided as in the present embodiment. In the case of providing two or more ink tanks 11, the ink tanks 11 may be provided on the right and the left relative to the center of the apparatus depending on the size of the printing apparatus 100, or provided only on one side. In the present embodiment, three color ink tanks 111 that can contain cyan ink, magenta ink, and yellow ink, respectively, are provided as the first ink tanks 111. Meanwhile, one black ink tank 112 that can contain black ink is provided as the second ink tank 112. Configurations of other components shown in FIG. 1 will be described later.

The printing apparatus 100 includes feeding rollers (not shown) that feed the print media, transportation rollers (not shown) that transport the print media, and discharge rollers (not shown) that discharge the print media. The print head 62 is detachably mounted on the carriage 61 and configured to eject the inks onto a surface of a print medium transported by the transportation rollers, thus printing an image thereon. Moreover, the printing apparatus 100 includes an ink suction mechanism 64 (see FIG. 4B) provided with a suction cap 65. In order to recover an ejection performance of the print head 62, the printing apparatus 100 brings the suction cap 65 into contact with the print head 62, and suctions the inks from ink ejection ports 63 (see FIG. 4B) of the print head 62 by using the ink suction mechanism 64. Here, the ink suction mechanism 64 includes a tube connected to the suction cap 65, and a suction pump serving as a suctioning unit, for example.

The present embodiment describes an example in which the print head 62 ejects the inks in accordance with a movement associated with scanning by the carriage. However, the present invention is not limited only to this configuration. The print head may be of a so-called line type, which is provided with ink ejection ports in a region corresponding to a width of the print medium and configured to print images on the print medium without scanning by the carriage.

Figure 2:
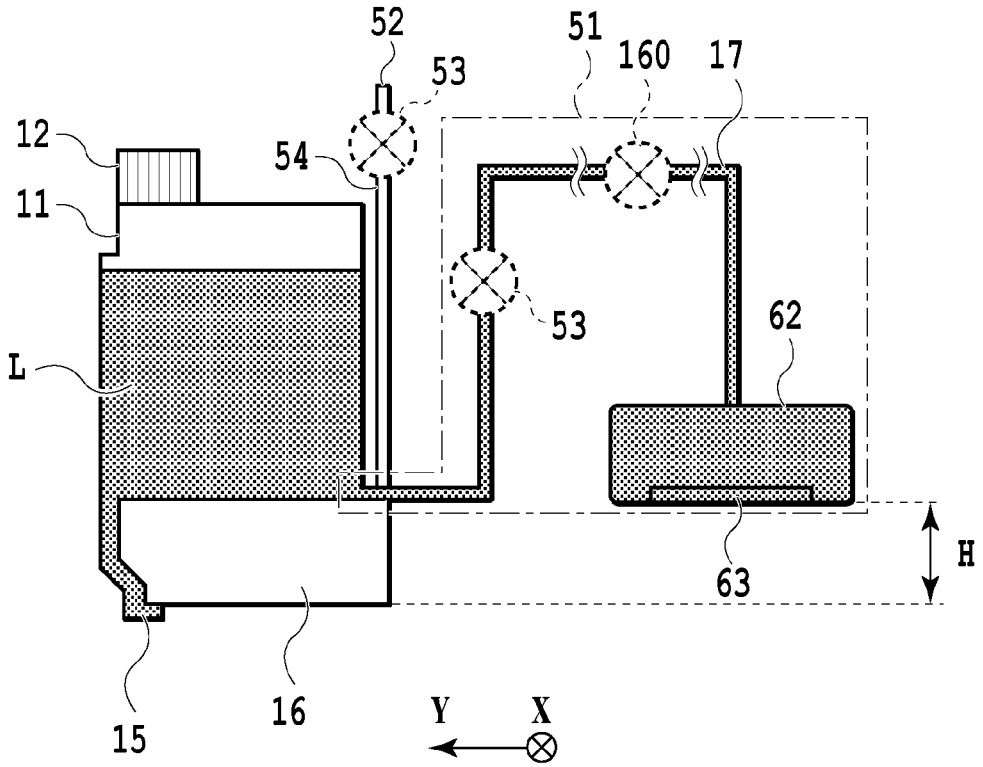
FIG. 2 is a schematic diagram showing a positional relation between an ink tank and a print head.

FIG. 2 is a schematic diagram showing a positional relation between the ink tank 11 and the print head 62. A supply tube 17 constituting the ink supply channel 51 for supplying the ink to the print head 62 is attached to the ink tank 11. Moreover, a tube constituting an atmospheric communicating channel 54 to establish communication of the inside of the ink tank 11 (a buffer chamber 16) with the atmosphere is connected to the ink tank 11. The supply tube 17 is formed from a flexible material such as an elastomer. Valve units 53 for blocking communication of a liquid or the air are provided at a portion of the ink supply channel 51 between the ink tank 11 and the print head 62 and at a portion of the atmospheric communicating channel 54 between the ink tank 11 and an atmosphere communicating opening 52, respectively.

The valve units 53 include a black side valve unit and color side valve units. The black side valve unit closes the ink supply channel 51 and the atmospheric communicating channel 54 connected to the black ink tank 112, respectively. The color side valve units close the ink supply channels 51 and the atmospheric communicating channels 54 connected to the color ink tanks 111, respectively. In the meantime, an on-off valve mechanism 160 to shut off the communication of the liquid or the air is provided at a portion of each ink supply channel 51 between the valve unit 53 and the print head 62. The on-off valve mechanisms 160 include a black side on-off valve mechanism and color side on-off valve mechanisms. The black side on-off valve mechanism closes the ink supply channel 51 connected to the black ink tank 112. The color side on-off valve mechanisms close the ink supply channels 51 connected to the color ink tanks 111, respectively. Each on-off valve mechanism 160 includes various components. Here, the black side on-off valve mechanism and the color side on-off valve mechanisms may use the same components in common or use different components from each other. Details of the on-off valve mechanisms will be described later. Differences in role between the on-off valve mechanism 160 and the valve unit 53 will also be described later.

In the printing apparatus 100 of the present embodiment, a liquid-gas replacement portion 15 of the ink tank 11 is located at a position lower by an amount H in a height direction than the ink ejection ports 63 of the print head 62 in order to prevent a leakage of the ink from the ink ejection ports 63 of the print head 62. In other words, a negative pressure originating from a water head difference corresponding to the height H is applied to the ink ejection ports 63. Meanwhile, the buffer chamber 16 is provided at a lower part of the ink tank 11. The buffer chamber 16 can store the ink to be pushed out in the case of destruction of a meniscus in the liquid-gas replacement portion 15 due to expansion of the air inside the ink tank 11 caused by an atmospheric pressure variation or a change in temperature. Thus, it is possible to suppress the leakage of the ink from the ink tank 11 through the atmospheric communicating channel 54. In FIG. 2 as well as FIGS. 4A and 4B to be described later, an open state of each of the valve units 53 and the on-off valve mechanism 160 is indicated with a dashed line and a closed state thereof is indicated with a solid line.

Next, a configuration of an ink supply system and a flow from a point of injection of the ink to a point to enable image printing in the present embodiment will be described with reference to FIGS. 3A to 5. FIGS. 3A to 3D are perspective views of the printing apparatus 100 according to the present embodiment. FIGS. 3A to 3D are the perspective views illustrating a process of transition from a state in FIG. 3A to a state in FIG. 3D in which a user can inject the ink into the ink tank 11. FIGS. 4A and 4B are schematic diagrams showing states of the ink tank 11 and the print head 62 according to the present embodiment.

Figure 3A:
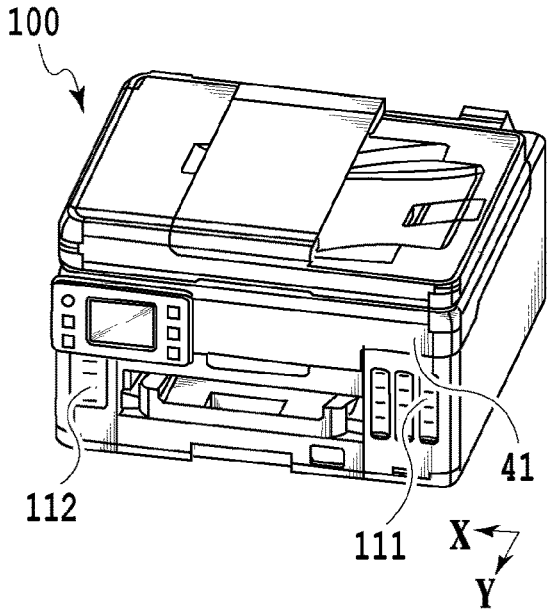
FIGS. 3A to 3D are perspective views of the printing apparatus.
Figure 4A:
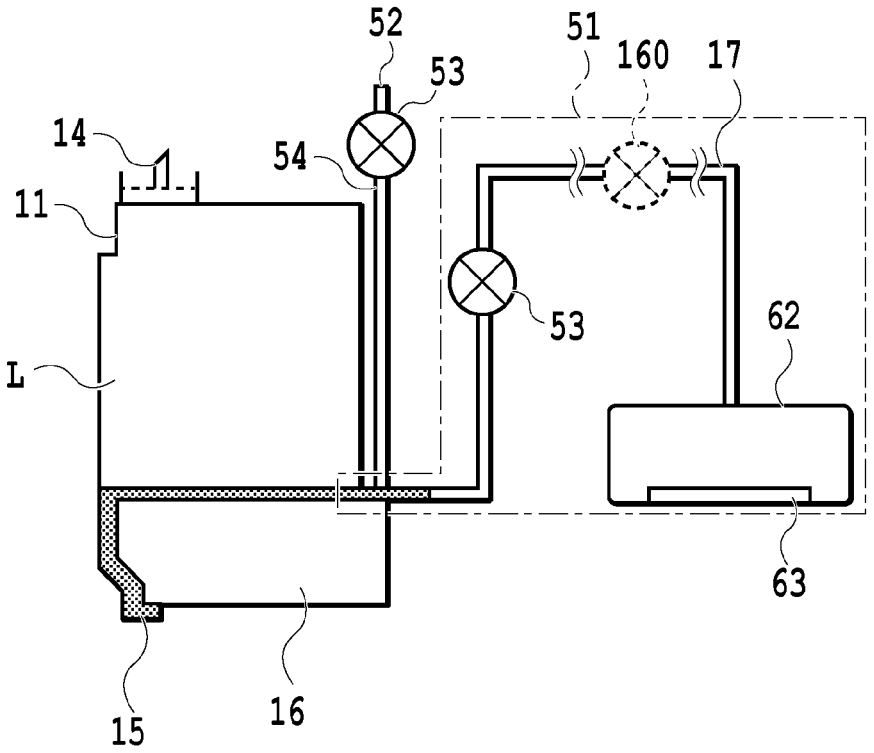
FIGS. 4A and 4B are schematic diagrams showing states of the ink tank and the print head.
Figure 4B:
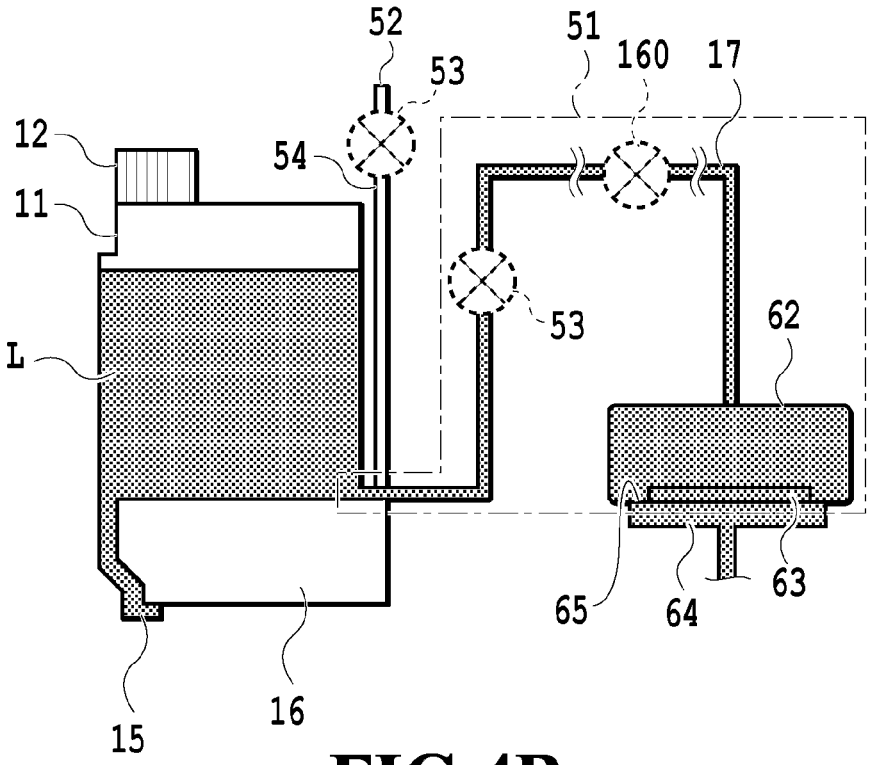

As shown in FIG. 3A, the printing apparatus 100 includes a third cover member 41, which is provided with a mechanism for reading an image on a loaded original document and is pivotally supported by the printing apparatus 100 in an openable and closable manner. Note that the third cover member 41 may be a reading mechanism to read the image on the original, or may be an access cover constituting an external upper surface which exposes part of internal components of the printing apparatus 100 in order to remove the print medium that causes a transportation failure in the course of image printing. The ink tank 11 is installed on a front surface side (+y direction side) of the printing apparatus 100 so that the user can easily inject the ink into the ink tank 11. As described above, the four ink tanks 11 in total, namely, the three color ink tanks 111 and the black ink tank 112 are provided in present embodiment. However, the types and the number of the ink tanks 11 are not limited to this example. For instance, more than four ink tanks 11 may be provided in order to improve quality of image printing on the print medium.

Figure 3B:
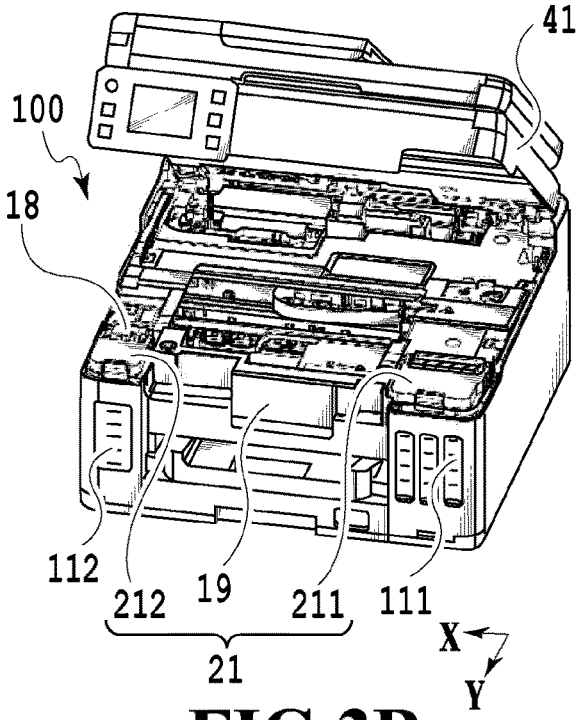

In the case where the user injects the ink into the ink tank 11, the user first turns the third cover member 41 upward and sets the third cover member 41 to the open state as shown in FIG. 3B. As the third cover member 41 is turned by a predetermined amount, the open state of the third cover member 41 can be maintained by use of a lock mechanism (not shown). Here, a cover sensor 18 is installed at a housing 19 and is capable of detecting the open state or the closed state of the third cover member 41. The cover sensor 18 is not limited to a mechanical sensor designed to detect mechanical contact. The cover sensor 18 may be may be an optical sensor, for example. Here, it is possible to release the lock mechanism by further turning the third cover member 41 upward. This action makes it possible to close the third cover member 41. By opening the third cover member 41, the internal components of the printing apparatus 100 are exposed and the user can operate a second cover member 21 (see FIGS. 3B and 1).

The second cover member 21 is pivotally supported in such a way as to be movable between a position to fall forward (a closed lid position) and a position to be lifted up (an open lid position). The ink tanks 11 are provided with the second cover members 21, respectively. To be more precise, the black ink tank 112 is covered with a black second cover member 212 and the three color ink tanks 111 are integrally covered with a single color second cover member 211. The black second cover member 212 and the color second cover member 211 will be collectively referred to as the second cover member 21. Although the black second cover member 212 and the color second cover member 211 are formed into different shapes in present embodiment, these cover members may be formed into the same shape instead.

Figure 3C:
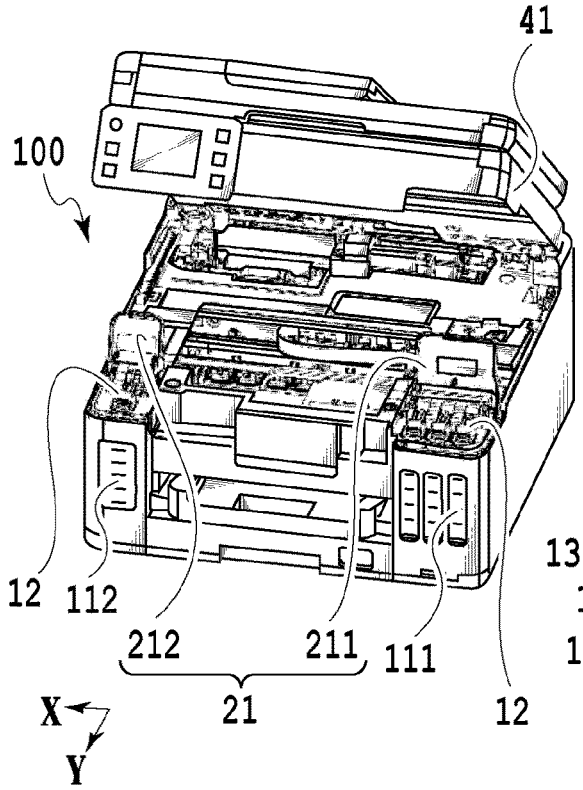
Figure 3D:
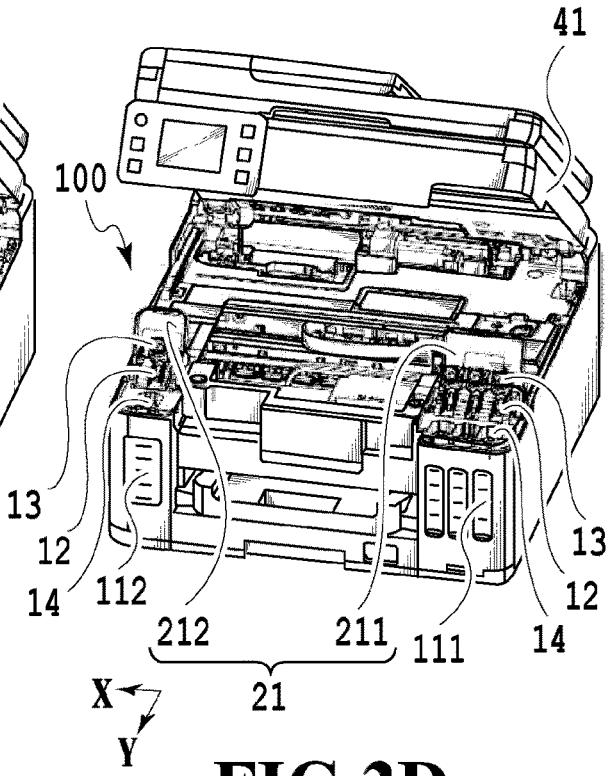

A first cover member 12 to close the ink tank 11 appears in the case where the user operates the second cover member 21 from the closed lid position to the open lid position (see FIGS. 1, 3C, and 4B). The first cover member 12 is pivotally supported in such a way as to be movable between a position to close the ink tank 11 (a closed tap position) and a position to be lifted up (an open tap position). An injection port 14 provided at an upper part of the ink tank 11 for user in injecting the ink appears in the case where the user operates the first cover member 12 from the closed tap position to the open tap position (see FIGS. 3D and 4A).

The first cover member 12 is provided with a seal member 13 formed from an elastic body such as rubber. By operating the first cover member 12 to the closed tap position, the seal member 13 closes the injection port 14 so as to prevent the leakage of the ink contained in the ink tank 11. In the present embodiment, the valve unit 53 acts in conjunction with the operation to lift the first cover member 12, thus closing the ink supply channel 51 and the atmospheric communicating channel 54, respectively (FIG. 4A).

The user can inject the ink into the ink tank 11 by putting a container (not shown) containing the ink into the injection port 14. After the injection of the ink is completed, the user operates the first cover member 12 to the closed tap position again. The valve unit 53 acts in conjunction with this operation, thus opening the ink supply channel 51 and the atmospheric communicating channel 54, respectively (see FIG. 4B). Thereafter, the user operates the second cover member 21 to the closed lid position, thus closing the third cover member 41. The printing apparatus 100 can detect the closure of the third cover member 41 by using the cover sensor 18 configured to detect the position of the third cover member 41. Upon detection of the closure of the third cover member 41, the printing apparatus 100 brings the suction cap 65 into contact with the print head 62 as shown in FIG. 4B in order to fill the ink supply channel 51 with an ink L inside the ink tank 11. Then, the ink suction mechanism 64 carries out a suctioning operation to suction the ink L from the ink ejection ports 63. The supply tube 17 constituting the ink supply channel 51 is filled with the ink as a consequence of this suctioning operation. Moreover, it is possible to conduct the suctioning operation while applying a larger negative pressure to the ink ejection ports 63 by carrying out on-off control of the on-off valve mechanism 160 at the time of this suctioning operation. To be more precise, the suction pump of the ink suction mechanism 64 is driven in the state of capping the print head 62 with the suction cap 65 while closing the on-off valve mechanism 160. In this way, the negative pressure is charged between the on-off valve mechanism 160 and the ink ejection ports 63 of the print head 62. Then, as the suction pump is stopped and the on-off valve mechanism 160 is opened, the print head 62 is filled with the ink by means of the charged negative pressure. In the meantime, the on-off valve mechanism 160 also has a role in closing the ink supply channel 51 so as to block the ink leakage in the case of moving the printing apparatus 100.

As described above, the ink supply channel 51 is provided with the two types of the valves in the present embodiment, namely, the valve unit 53 and the on-off valve mechanism 160, which have the functions independent of and different from each other. Specifically, the valve unit 53 closes the ink supply channel 51 in the case of filling the ink tank 11 with the ink and opens the ink supply channel 51 in other cases. On the other hand, the on-off valve mechanism 160 closes the ink supply channel 51 in order to suppress the ink leakage or in the case of conducting efficient suctioning at the time of filling the ink. Details of the on-off valve mechanism 160 will be described later.

In the state filled with the ink as described above, as the ink is ejected from the ink ejection ports 63 in the case of printing an image on the print medium, for example, the ink is supplied from the ink tank 11 to the print head 62 in an amount equivalent to an amount of the ink discharged from the print head 62. The ink is continuously supplied from the ink tank 11 to the print head 62 until the ink in the ink tank 11 falls below a predetermined amount.

The above-described example has explained the case where the user conducts the opening and closing operations by operating the first cover member 12, the second cover member 21, and the third cover member 41. Instead, the opening and closing operations may be carried out automatically by means of control inside the printing apparatus 100.

<Ink Filling Sequence>

Figure 5:
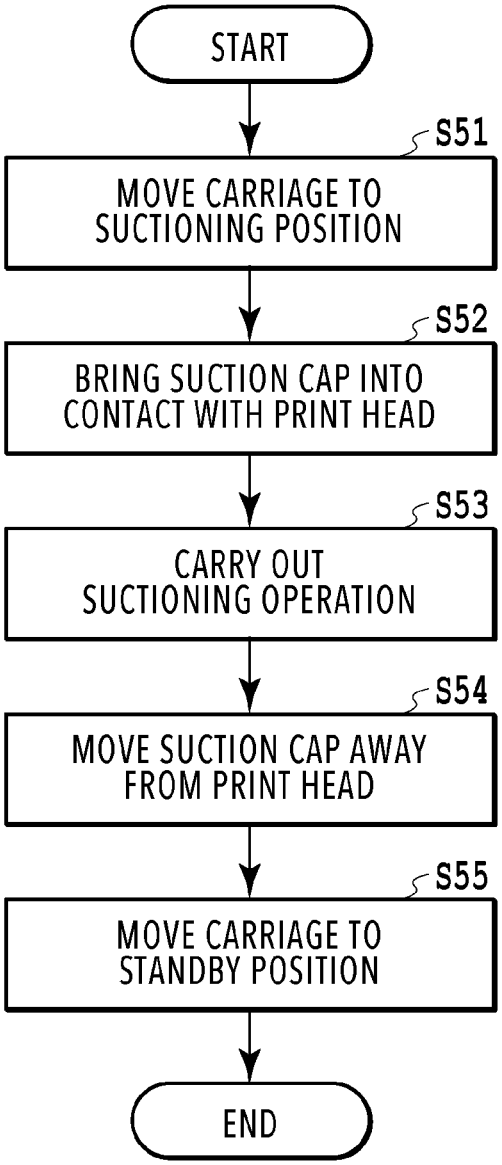
FIG. 5 is a flowchart of an ink filling sequence.

FIG. 5 is a flowchart of an ink filling sequence. In the case where the ink filling sequence is started, the printing apparatus 100 moves the carriage 61 that holds the print head 62 to a suctioning position opposed to the suction cap 65 in S51 to begin with. In S52, the printing apparatus 100 brings the suction cap 65 into contact with the print head 62. In S53, the printing apparatus 100 carries out the suctioning operation to suction the ink from the ink ejection ports 63 of the print head 62 by using the suction cap 65. In this instance, the suctioning operation may be carried out together with the on-off control of the on-off valve mechanism 160 as discussed earlier. After the completion of the suctioning operation, the printing apparatus 100 moves the suction cap 65 away from the print head 62 in S54. Then, in S55, the printing apparatus 100 moves the carriage 61 from the suctioning position to a standby position. Thus, the operations of the series of the ink filling sequence are terminated.

<Block Diagram>

Figure 6:
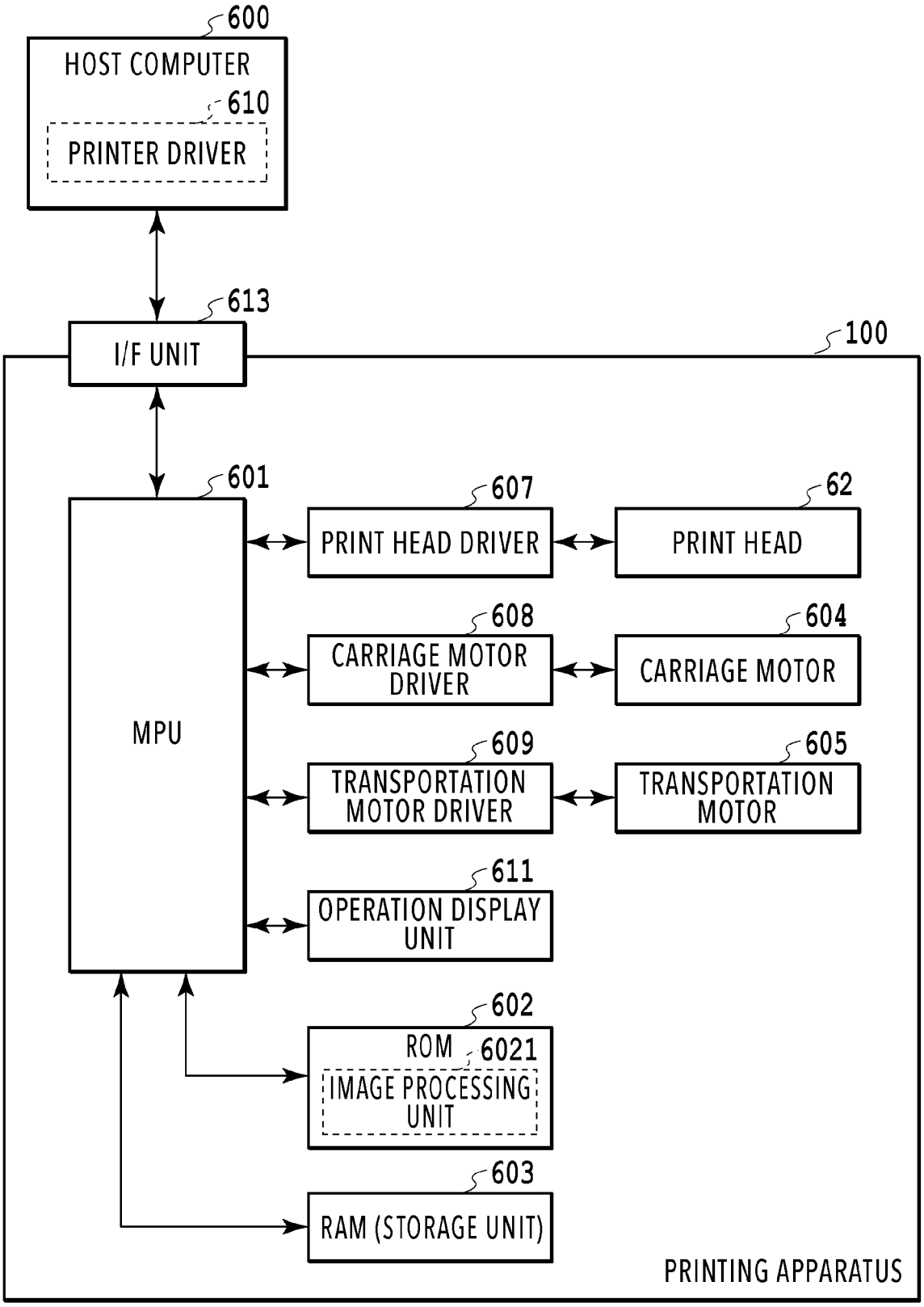
FIG. 6 is a block diagram including a configuration of the printing apparatus.

FIG. 6 is a block diagram including a configuration of the printing apparatus 100 according to the present embodiment. The printing apparatus 100 includes the print head 62, an MPU 601, a ROM 602, a RAM 603, a carriage motor 604, a transportation motor 605, a print head driver 607, a carriage motor driver 608, a transportation motor driver 609, and an I/F unit 613. A program that functions as an image processing unit 6021 is stored in the ROM 602.

The MPU 601 controls operations of the respective units, data processing, and the like. The ROM 602 stores programs and data to be executed by the MPU 601. The RAM 603 temporarily stores processing data to be executed by the MPU 601 and data received from a host computer 600. The print head 62 is controlled by the print head driver 607. The carriage 61 is driven by the carriage motor 604. The carriage motor 604 is controlled by the carriage motor driver 608. The feeding rollers, the transportation rollers, and the discharge rollers are driven by the transportation motor 605. The transportation motor 605 is controlled by the transportation motor driver 609. The host computer 600 includes a printer driver 610 for processing print information such as a printed image and image quality and for communicating with the printing apparatus 100 in the case where the user issues a command to execute a printing operation. The MPU 601 exchanges printed images and the like with the host computer 600 through the I/F unit 613.

<Configuration of On-Off Valve Mechanism>

Figure 7A:
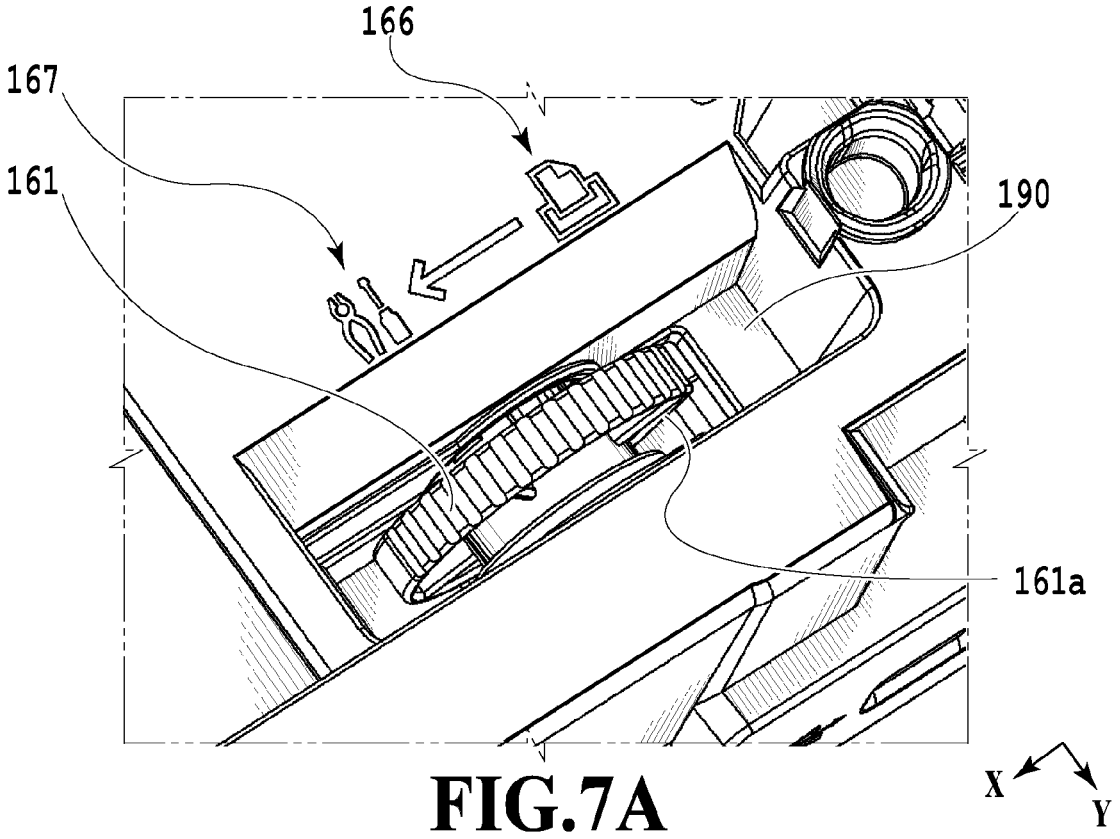
FIGS. 7A and 7B are perspective views of an operating unit in an on-off valve mechanism.
Figure 7B:
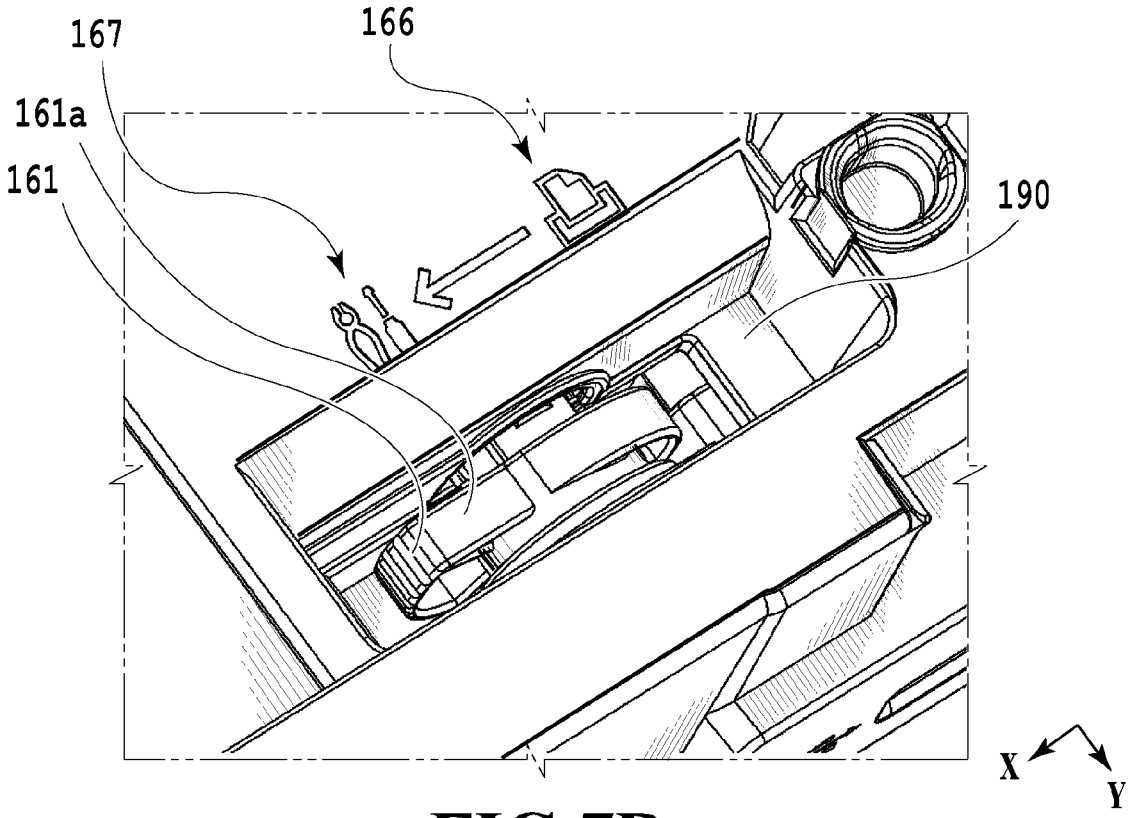
Figure 8:
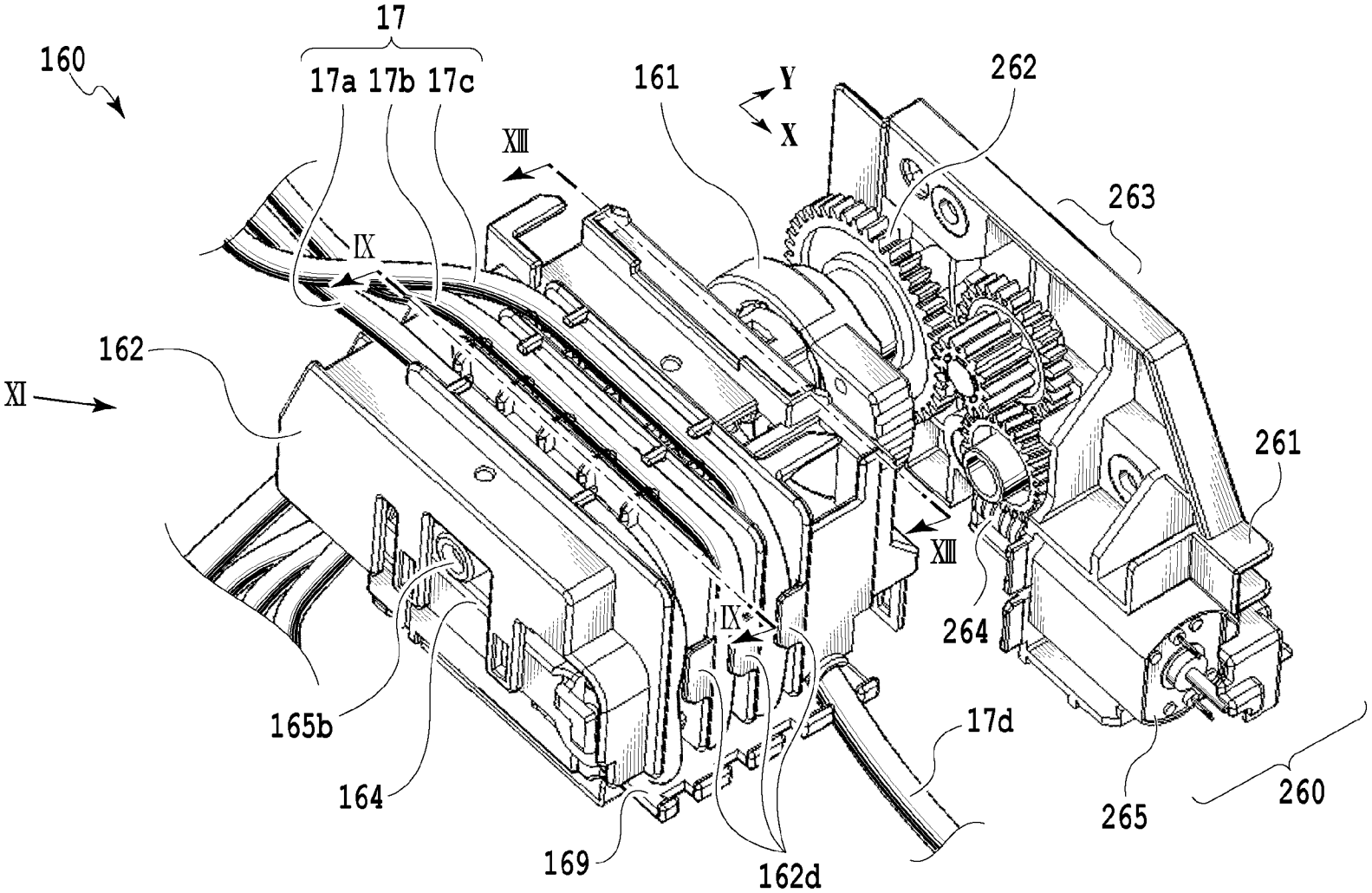
FIG. 8 is a perspective view showing an outline of the on-off valve mechanism.
Figure 9A:
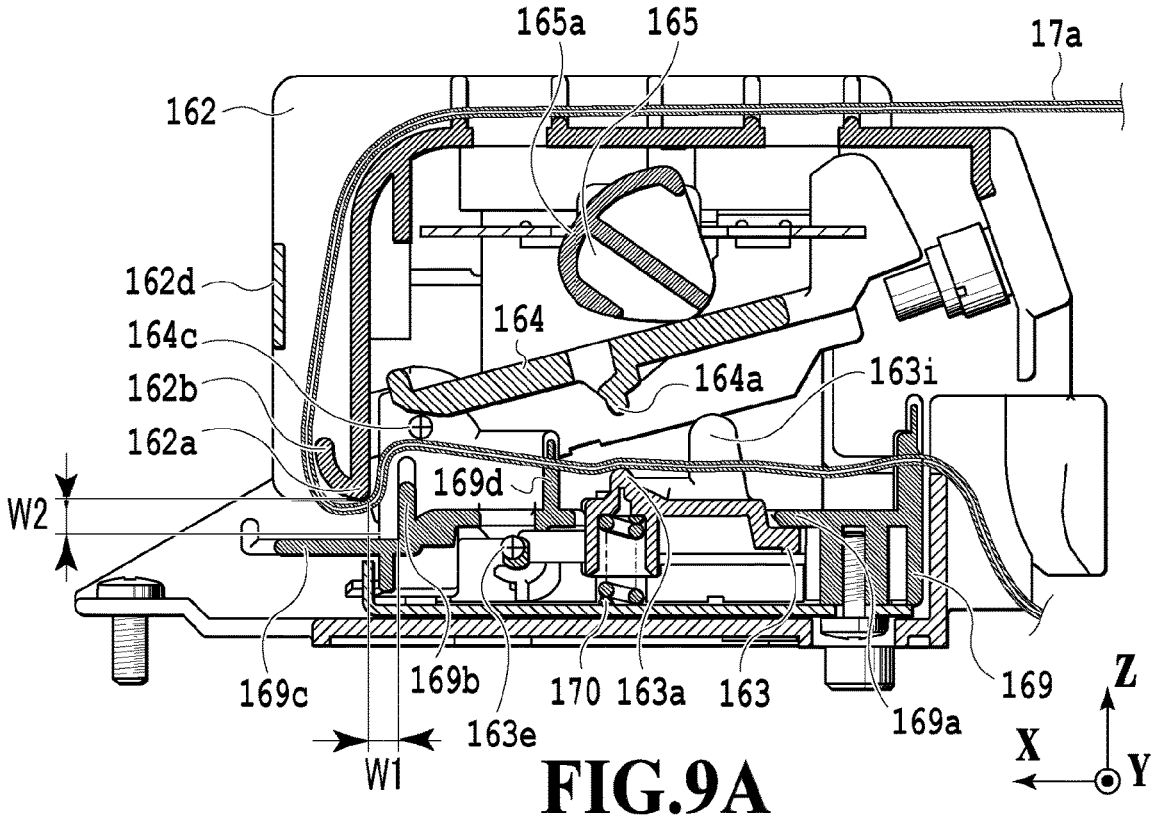
FIGS. 9A and 9B are cross-sectional views showing the outline of the on-off valve mechanism.
Figure 9B:
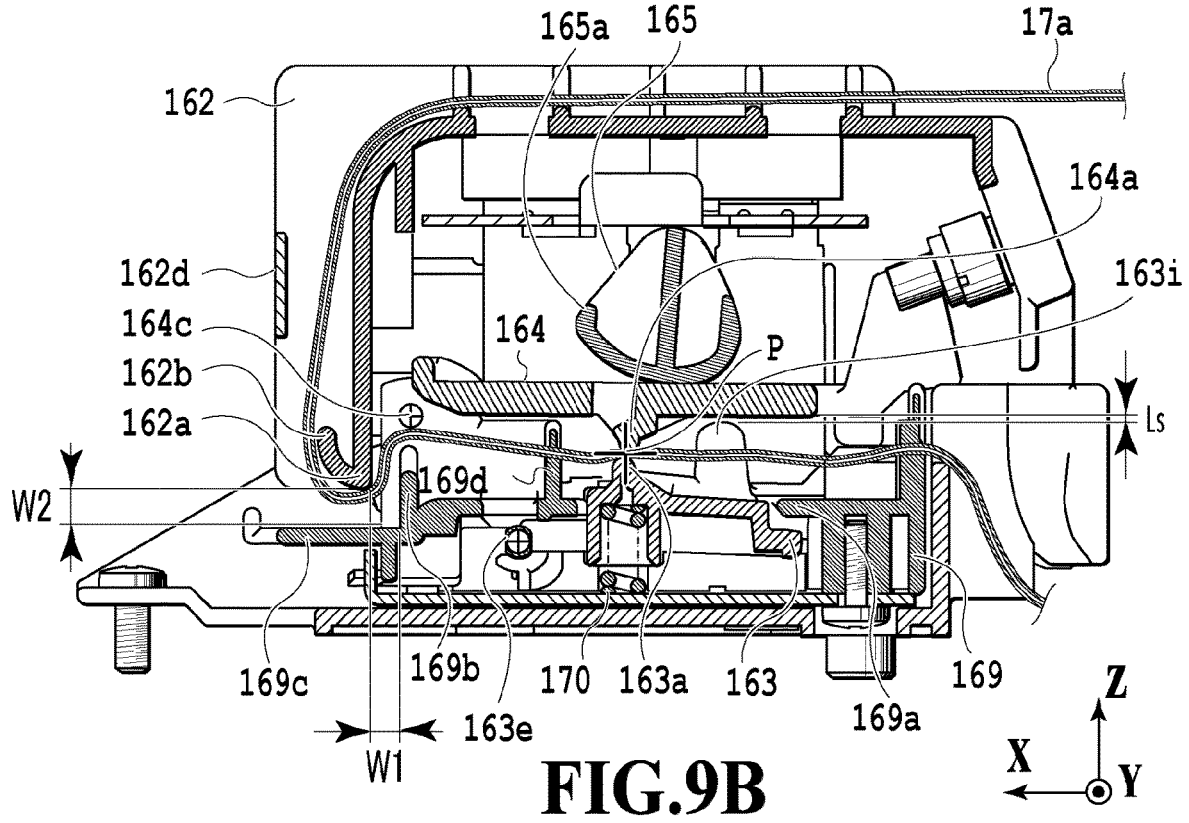
Figure 10:
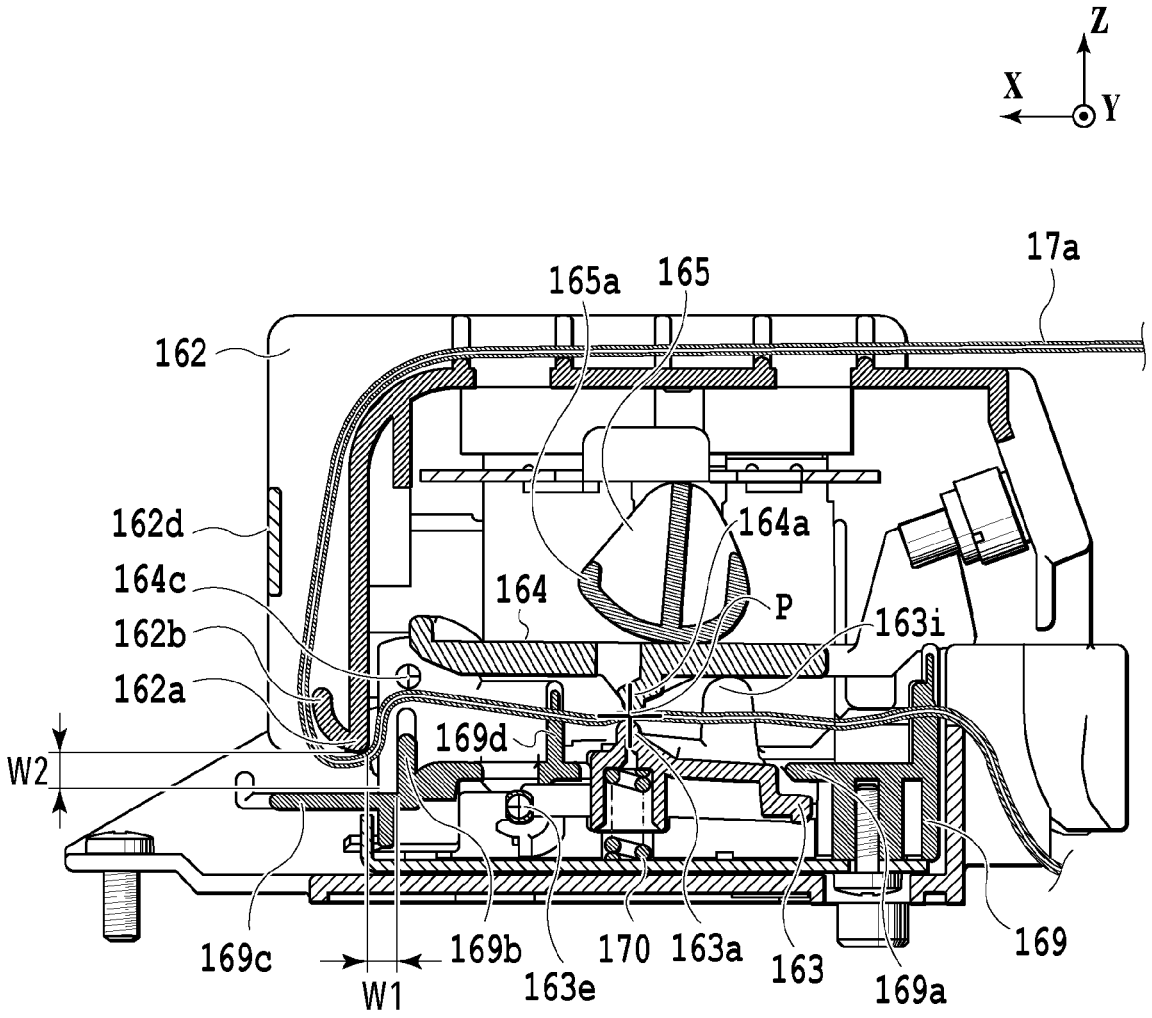
FIG. 10 is a cross-sectional view showing an outline of the on-off valve mechanism.
Figure 11:
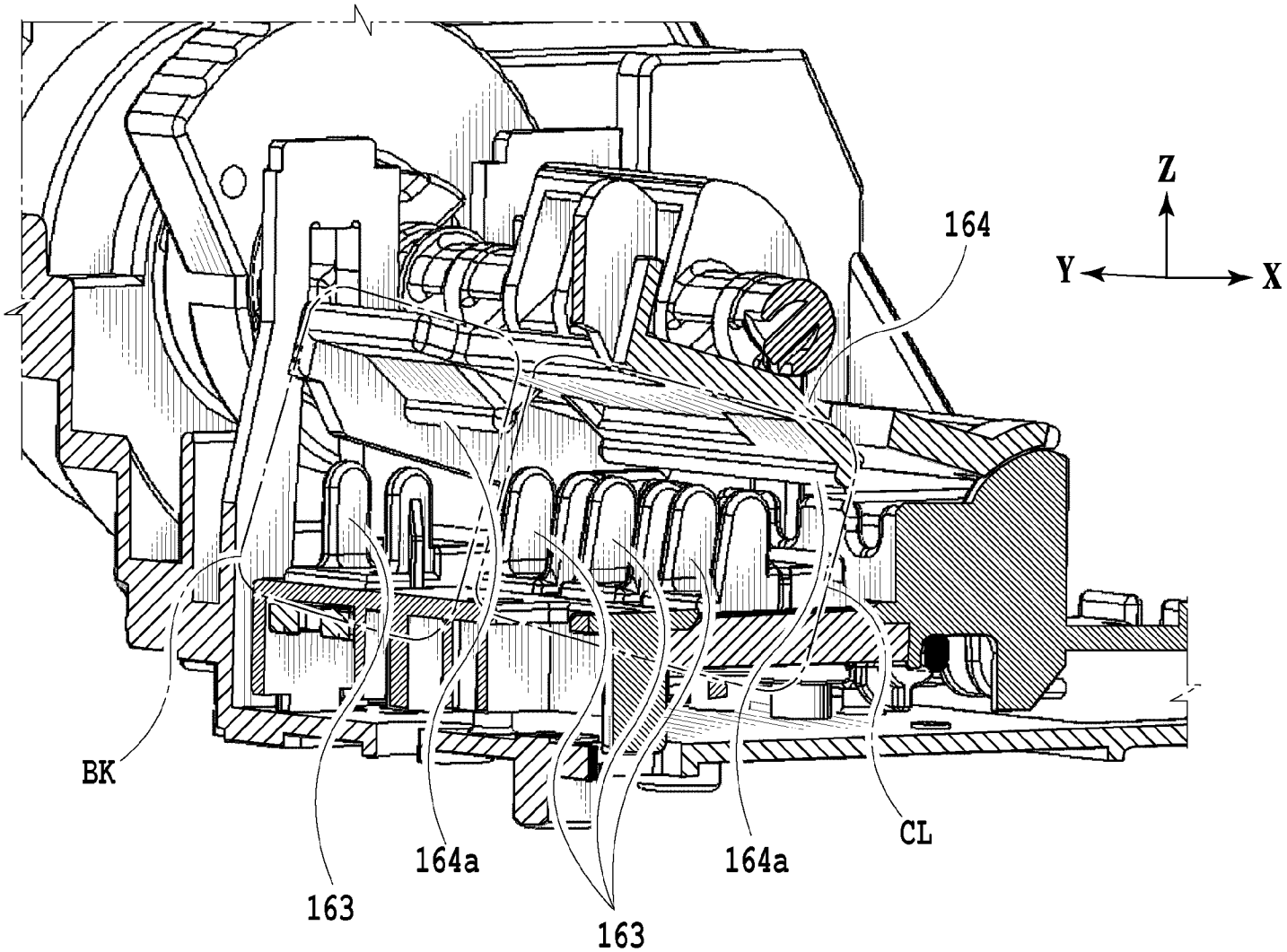
FIG. 11 is a perspective view of the on-off valve mechanism.
Figure 12A:
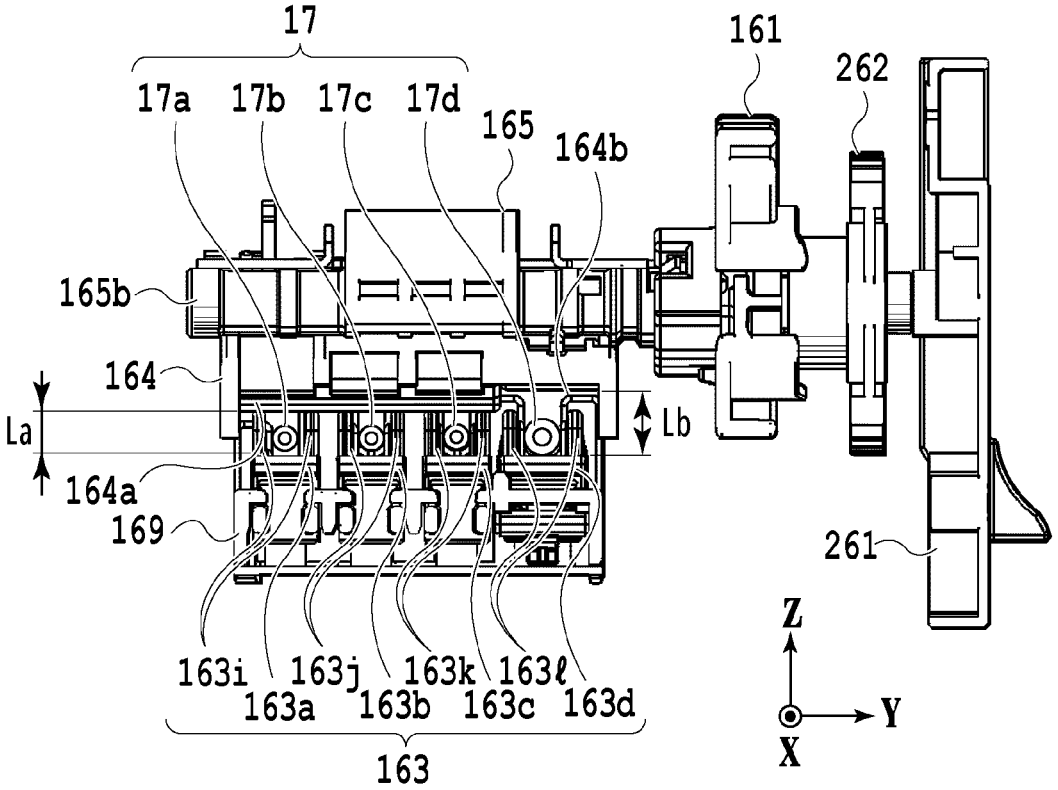
FIGS. 12A and 12B are side views of on-off valve mechanism.
Figure 12B:
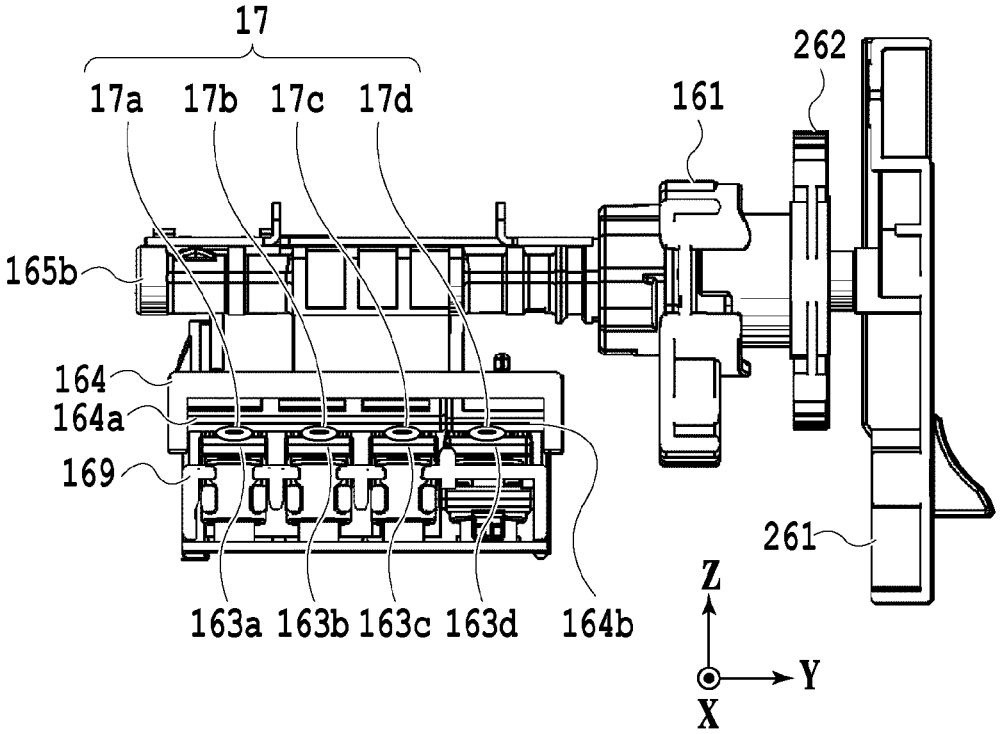
Figure 13:
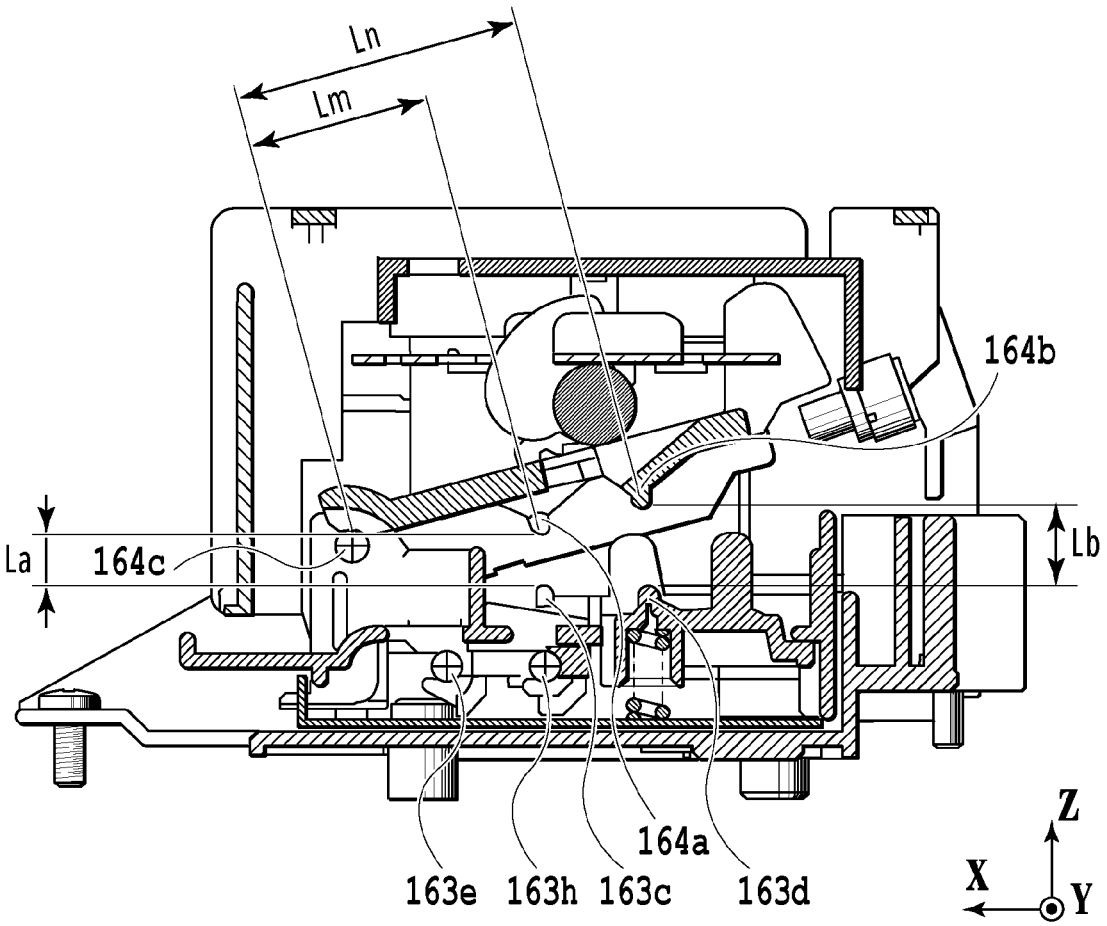
FIG. 13 is a cross-sectional view showing the outline of the on-off valve mechanism.

Next, a description will be given of a configuration and operations of the on-off valve mechanism 160 according to the present embodiment. FIGS. 7A and 7B are perspective views of an operating unit 161 in the on-off valve mechanism 160 according to the present embodiment. FIG. 8 is a perspective view showing an outline of the on-off valve mechanism 160 according to the present embodiment. FIGS. 9A and 9B are cross-sectional views showing the outline of the on-off valve mechanism 160 according to the present embodiment. FIGS. 9A and 9B are cross-sectional view taken along the IX sectional line in FIG. 8. FIG. 9A is a diagram showing an open state of the on-off valve mechanism 160 and FIG. 9B is a diagram showing a closed state of the on-off valve mechanism 160. FIG. 10 is a cross-sectional view showing the closed state of the on-off valve mechanism 160 as with FIG. 9B. FIG. 11 is a perspective view of the on-off valve mechanism 160 from a different viewpoint from that of FIG. 8. FIGS. 12A and 12B are side views of the on-off valve mechanism 160. FIG. 12A shows the open state of the on-off valve mechanism 160 and FIG. 12B shows the closed state of the on-off valve mechanism 160. FIG. 13 is a cross-sectional view showing an outline of the on-off valve mechanism 160. FIG. 13 is the cross-sectional view taken along the XIII sectional line in FIG. 8. The following description will be given mainly with reference to FIGS. 7A to 13 as appropriate.

As described above, the on-off valve mechanism 160 is the valve for closing and opening (establishing communication of) the ink supply channel 51 formed from the supply tube 17. As shown in FIGS. 1, 7A, 7B, and 8, the on-off valve mechanism 160 includes the operating unit 161 which is manually operable by the user. The operating unit 161 is configured to enable the user to perform a rotating operation by using an operating surface 161*a*. The on-off valve mechanism 160 is disposed at the ink supply channel 51 and is capable of switching between an open state to establish communication between the ink tank 11 and the print head 62 and a closed state to block the communication by operating the operating unit 161. Moreover, as shown in FIGS. 7A and 7B, a print mark 166 and a maintenance mark 167 are drawn at operating positions of the operating unit 161 so as to enable the user to intuitively recognize on-off states of a valve in the on-off valve mechanism 160. In the case where the operating surface 161*a* of the operating unit 161 is located at the position of the print mark 166, the on-off valve mechanism 160 is not closing the ink supply channel 51 and is therefore in the state where the ink can be supplied from the ink tank 11 to the print head 62. In other words, the printing apparatus 100 is in a state of being capable of printing on the print medium. On the other hand, the on-off valve mechanism 160 closes the ink supply channel 51 in the case where the operating unit 161 is rotated from the position of the print mark 166 to the maintenance mark 167 and the operating surface 161*a* is located on the side indicated with the maintenance mark 167. As a consequence, the ink is not supplied from the ink tank 11 to the print head 62. Accordingly, the user can perform an operation to replace the print head 62 or an operation to transport the printing apparatus 100 in the state of suppressing the movement of the ink in the ink supply channel 51. Meanwhile, it is possible to carry out initial filling of the print head 62 with the ink or an operation to remove bubbles from the ink supply channel 51 efficiently by conducting the above-described suctioning operation in the closed state of the ink supply channel 51 with the on-off valve mechanism 160.

The on-off valve mechanism 160 according to the present embodiment enables opening and closing operations manually and automatically by coupling a driving unit thereto. Here, the driving unit can be electrically driven by an external power supply. In other words, the operating unit 161 can switch between the open state and closed state by driving the external driving unit in addition to the manual operation of the user. As shown in FIG. 3B, the printing apparatus 100 includes the housing 19. Moreover, as shown in FIGS. 7A and 7B, the housing 19 includes an opening portion 190. The operating unit 161 is disposed in the opening portion 190. Meanwhile, since the cover sensor 18 (FIG. 3B) is provided in the present embodiment, the printing apparatus 100 can detect by using the cover sensor 18 as to whether or not the operating unit 161 is in a state operable by the user.

As shown in FIGS. 8 to 13, the on-off valve mechanism 160 includes the operating unit 161, the cover member 162, a receiving member 163, a displacement member 164, a cam 165, a holding member 169, a biasing member 170, and a driving mechanism 260.

As shown in FIGS. 8 to 9B, the cover member 162 and the holding member 169 have shapes to define an arrangement route of the supply tubes 17, respectively, and hold the supply tubes 17 in the vicinity of the on-off valve mechanism 160. In the present embodiment, one end of each supply tube 17 is connected to the print head 62 while the other end thereof is connected to the corresponding ink tank 11. Meanwhile, the supply tubes 17 of the present embodiment include supply tubes 17*a*, 17*b*, 17*c*, and 17*d*. Each supply tube 17 includes a bending region which is bendable along with the movement of the print head 62. The on-off valve mechanism 160 is arranged such that the bendable region of each supply tube 17 is located between the print head 62 and the cover member 162. In other words, the on-off valve mechanism 160 is disposed at a region of each supply tube 17 which does not move along with the movement of the carriage 61.

As shown in FIGS. 9A to 13, the displacement member 164 includes pressing portions 164*a* and 164*b* that press the supply tubes 17, and a first pivot shaft 164*c*. The displacement member 164 is biased pivotally about the first pivot shaft 164*c* in a direction toward the cam 165 to be described later by using a not-illustrated biasing member. In the meantime, the displacement member 164 is a member which is capable of pivotally moving about the first pivot shaft 164*c* and is displaceable in a direction to interfere with the supply tubes 17. In other words, the displacement member 164 is provided in such a way as to be capable of advancing and receding to and from the supply tubes 17.

The receiving member 163 is a member for receiving the displacement member 164 that is displaceable in the direction to interfere with the supply tubes 17, and includes contact portions 163*a*, 163*b*, 163*c*, and 163*d*, and second pivot shafts 163*e* and 163*h*. The second pivot shafts 163*e* and 163*h* are fitted into a bearing portion provided to the holding member 169, and the receiving member 163 is pivotally movable about the second pivot shafts 163*e* and 163*h*. The receiving member 163 is provided on an opposite side to a portion provided with the displacement member 164 in such a way as to correspond to each supply tube 17. The receiving member 163 is biased by the biasing member 170 in a direction to come close to the displacement member 164. The receiving member 163 is biased by the biasing member 170 toward a rotation stopper 169*a* of the holding member 169, thereby controlling an amount of pivotal movement toward a portion holding the supply tube 17. The receiving members 163 are provided for the respective tubes, and each receiving member 163 is biased by the biasing member 170 toward the rotation stopper 169*a* of the holding member 169. Meanwhile, each receiving member 163 includes a pivot shaft. In the present embodiment, the pivot shafts of the receiving members 163 corresponding to the contact portions 163*a*, 163*b*, and 163*c* are the second pivot shafts 163*e*. Although FIG. 9 shows the second pivot shaft 163*e* corresponding to the contact portion 163*a*, the second pivot shafts 163*e* of the receiving members 163 corresponding to the contact portions 163*b* and 163*c* are also included on the back side of the sheet surface. The pivot shaft of the receiving member 163 corresponding to the contact portion 163*d* is the second pivot shaft 163*h* (see FIG. 13). Although the description has been given of the example of providing the pivot shafts for the respective receiving members 163, the pivot shafts only need to be provided independently of two or more receiving members 163. In this context, the single second pivot shaft 163*e* may be shared as the pivot shafts for the receiving members 163 corresponding to the contact portions 163*a*, 163*b*, and 163*c*, for example.

The present embodiment provides the pressing portion 164*a* of the displacement member 164 which acts on the first tubes, and the contact portions 163*a*, 163*b*, and 163*c* of the receiving members 163 corresponding thereto (see FIGS. 12A and 12B). Moreover, the present embodiment provides the pressing portion 164*b* of the displacement member 164 which acts on a second tube, and the contact portion 163*d* of the receiving member. The first tubes are the supply tubes 17*a*, 17*b*, and 17*c* for cyan, magenta, and yellow, for example. The second tube is the supply tube 17*d* for black. As described above, the present embodiment is configured to press the supply tubes by using the two pressing portions 164*a* and 164*b*.

The description will be continued with reference to FIGS. 9A and 9B. Note that FIGS. 9A and 9B show the supply tube 17*a* as an example. Accordingly, the description will be given below of the example concerning the pressing portion 164*a* and the contact portion 163*a* that act on the supply tube 17*a*. Unless specifically stated otherwise in the description, the same explanations will apply to the pressing portions 164*a* and 164*b* of the displacement member 164 which act on the remaining supply tubes 17*b*, 17*c*, and 17*d*, and to the contact portions 163*b*, 163*c*, and 163*d* of the receiving members 163. The displacement member 164 and each receiving member 163 are pivotally movably supported so as to be able to come close to and recede from each other, and a direction of extension of pivot shafts thereof is provided along a direction of the sheet surface (y direction) of FIGS. 9A and 9B, which is a direction intersecting (at right angle in this example) with a long direction (x direction in FIGS. 9A and 9B) of the tubes. Accordingly, even in a case where diameters of the tubes or thicknesses of the tubes vary and there are differences in reactive force in y direction among the tubes, inclinations of the pressing portion 164*a* and the contact portion 163*a* in terms of a yz cross-section are regulated by the pivot shafts so that a leakage can be suppressed. Although the present embodiment describes the example of providing the first pivot shaft 164*c* and the second pivot shafts 163*e* and 163*h*, a leakage can be suppressed likewise by using any one of the pivot shafts.

As shown in FIGS. 8 to 11, the cam 165 includes a cam surface 165*a* and a cam shaft 165*b*. The cam 165 is rotated by being engaged with the operating unit 161, thus displacing the displacement member 164. The cam 165 may be provided separately from the operating unit 161 or may be integrated with the operating unit 161. As shown in FIGS. 9A and 9B, the cam 165 is configured such that the cam surface 165*a* comes into contact with the displacement member 164. In the case where the operating unit 161 is rotated manually or automatically, the cam 165 is rotated around the cam shaft 165*b* along with this rotation, and the displacement member 164 pushed by the cam surface 165*a* is displaced accordingly. Then, the pressing portion 164*a* of the displacement member 164 presses the supply tube 17*a* against the contact portion 163*a* of the receiving member 163, thereby crushing the supply tube 17*a*. Thus, the ink supply channel 51 is closed. In other words, the on-off valve mechanism 160 is set to the closed state. The displacement member 164 including the pressing portions 164*a* and 164*b* will be hereinafter referred to as a valve mechanism or more simply as a valve. As described above, the displacement member 164 is configured to be movable between a closed position to close the supply tubes 17 and an open position to open the supply tubes 17.

As shown in FIG. 8, the driving mechanism 260 includes a driving mechanism holding unit 261, a drive transmission gear 262 which is a drive transmission unit to transmit the drive to the operating unit 161, an intermediate gear train 263, and a motor 265. The driving mechanism holding unit 261 includes the drive transmission gear 262, the intermediate gear train 263, and the motor 265. The motor 265 includes a motor gear 264. The drive transmission gear 262 engages with the operating unit 161. A driving force is transmitted from the motor 265 connected to the external power supply (not shown) to the drive transmission gear 262 through the intermediate gear train 263, which rotates the operating unit 161 engaged therewith. Thus, it is possible to close and establish communication of the ink supply channels 51 automatically by displacing the displacement member with the cam 165. Here, it is possible to control a direction of drive transmission in one direction from the motor 265 side to the operating unit 161 side by using a worm gear for the motor gear 264 as in the present embodiment. However, the motor gear 264 is not limited only to the worm gear and other publicly known gears may be used instead.

FIGS. 12A and 12B are the side views of the configuration of the on-off valve mechanism 160 according to the present embodiment. FIG. 12A shows the open state of the on-off valve mechanism 160 and FIG. 12B shows the closed state of the on-off valve mechanism 160. The pressing portions 164*a* and 164*b* of the displacement member 164 are formed to integrally press the supply tubes 17. The receiving members 163 include auxiliary supporting portions 163*i*, 163*j*, 163*k*, and 163*l* located at positions capable of coming into contact with the displacement member 164. The receiving members 163 and the biasing members 170 for biasing the receiving members are provided as many as the number of the supply tubes 17 so as to individually come into contact with and support the supply tubes 17, respectively. The auxiliary supporting portions 163*i*, 163*j*, 163*k*, and 163*l* support the supply tubes 17 near pressing positions P (see FIG. 9B) where the supply tubes 17 are closed by the pressing portions 164*a* and 164*b* and the contact portions 163*a*, 163*b*, 163*c*, and 163*d*. In other words, the auxiliary supporting portions 163*i*, 163*j*, 163*k*, and 163*l* are provided at the positions near the contact portions 163*a*, 163*b*, 163*c*, and 163*d*, which are different from the positions of the contact portions 163*a*, 163*b*, 163*c*, and 163*d*. Contact surfaces of the auxiliary supporting portions 163*i*, 163*j*, 163*k*, and 163*l* with the tubes are provided within widths in y direction of the contact portions 163*a*, 163*b*, 163*c*, and 163*d*. In other words, each of the auxiliary supporting portions 163*i*, 163*j*, 163*k*, and 163*l* includes a substantially U-shaped groove portion so as to arrange the corresponding tube in the groove portion. Since the positions of the auxiliary supporting portions are located at different positions from the pressing positions P, it is possible to regulate positions in y direction of the supply tubes 17 without hindering the closure of the supply tubes 17 at the pressing positions P or increasing the size in y direction of the on-off valve mechanism 160.

<Operation to Close Supply Tube>

Next, a description will be given of an operation by the on-off valve mechanism 160 according to the present embodiment to close each supply tube 17 with reference to FIGS. 9A and 9B.

As mentioned earlier, FIGS. 9A and 9B show the cross-sectional views at the location to close the supply tube 17*a* in the on-off valve mechanism 160. FIG. 9A shows the state (the open state) in which the pressing portion 164*a* of the displacement member 164 does not crush the supply tube 17*a* and the ink supply channel 51 establishes communication. In this state, the ink in the supply tube 17*a* can be supplied from the ink tank 11 to the print head 62 through the ink supply channel 51. If the operating unit 161 is manually or automatically rotated in this state, the cam surface 165*a* of the cam 165 is also rotated whereby the cam surface 165*a* is displaced in a direction to cause the displacement member 164 to interfere with the supply tube 17*a*.

FIG. 9B shows the state (the closed state) in which the pressing portion 164*a* of the displacement member 164 crushes the supply tube 17*a* and the ink supply channel 51 is closed. In this state, the supply tube 17*a* is crushed between the pressing portion 164*a* of the displacement member 164 and the contact portion 163*a* of the receiving member 163 whereby the ink supply channel 51 for the supply tube 17*a* is closed. In this state in FIG. 9B, the supply tube 17*a* is in a state of being unable to supply the ink in the ink tank 11 to the print head 62 and in a state of not permitting the flow of the air therein. As shown in FIG. 9B, there is a clearance Ls between the auxiliary supporting portion 163*i* provided to the receiving member 163 and the displacement member 164 in the closed state of the ink supply channel 51. The receiving member 163 is in a state where a reactive force at the time of closing the supply tube 17*a* is equal to a biasing force of the biasing member 170. Accordingly, it is possible to apply a constant pressure with a force required for closing the tube while absorbing tolerances of the supply tube 17*a* and other components. By rotating the cam 165 to displace the cam surface 165*a* from the state in FIG. 9B, the displacement member 164 retracts toward the cam 165 by using the not-illustrated biasing member, thus returning to the state in FIG. 9A. The supply tube 17*a* releases the closed state by its own resilience.

Here, the first pivot shaft 164*c* is preferably provided at substantially the same height as the contact portion 163*a* in terms of the height in z direction at the time of the closed state shown in FIG. 9B. Hence, it is possible to reduce slide in x direction between the pressing portion 164*a* as well as the contact portion 163*a* and the supply tube 17*a* in the case of closing the tube, thereby suppressing wear. In other words, a difference in height in z direction between the first pivot shaft 164*c* and the contact portion 163*a* is preferably below a predetermined value. While the predetermined value can be determined as appropriate depending on the sizes of the components, the value is preferably a sufficient value for suppressing the wear. For example, the predetermined value may be defined as a sum of a thickness of the pressing portion 164*a* of the displacement member 164 and a thickness of the contact portion 163*a* of the receiving member 163.

FIG. 10 shows a state where the printing apparatus 100 is stored for a long time in a posture in which the ink supply channel 51 shown in FIG. 9B is closed. The ink supply channel 51 may be kept closed for a long time for the purpose of transportation of the printing apparatus 100 and the like. In the present embodiment, the receiving member 163 biased by the biasing member 170 may be turned upward and the clearance Ls may be lost in the case where the supply tube 17*a* is stored in the closed state for a long time. Then, the displacement member 164 receives the pressure from the receiving member 163 as the auxiliary supporting portion 163*i* comes into contact with the displacement member 164 as shown in FIG. 10, whereby the pressure applied to the supply tube 17*a* is reduced. Accordingly, it is possible to suppress development of deformation (creap) of the supply tube 17*a* attributed to the storage for a long time.

Next, an operation to close the supply tube 17 will be described with reference to FIGS. 12A and 12B. As mentioned earlier, FIG. 12A is the side view showing the on-off valve mechanism 160 in the open state. In the present embodiment, a tube outside diameter and a tube thickness of the supply tubes 17*a*, 17*b*, and 17*c* are different from those of the supply tube 17*d* as shown in FIG. 12A. As mentioned earlier, FIG. 12B is the side view showing the on-off valve mechanism 160 in the closed state. The ink supply channels 51 of the supply tubes 17 for all the ink colors are integrally closed by the displacement of the displacement member 164. In the closed state in FIG. 12B, reactive forces at the time of closing the tubes vary since the tube outside diameter and the tube thickness of the supply tubes 17*a*, 17*b*, and 17*c* are different from those of the supply tube 17*d*. In the present embodiment, the direction of extension of pivot shafts of the displacement member 164 and the receiving members 163 is the direction (y direction) which is orthogonal to the long direction (x direction) of the supply tubes 17. Accordingly, even in the case of integrally pressing the tubes having the different reactive forces at the time of closure, it is possible to minimize the inclination on the yz planes of the pressing portions 164*a* and 164*b* and the contact portions 163*a*, 163*b*, 163*c*, and 163*d*. Thus, the tubes having the different tube outside diameters and the different thicknesses can be stably closed in the case of integrally closing these tubes. Although this example explains the case where the tube outside diameter and the tube thickness of the supply tubes 17*a*, 17*b*, and 17*c* are different from those of the supply tube 17*d*, the present invention is not limited only to this example. The same effect is obtained even in a case where at least one of the tube outside diameter and the tube thickness of the supply tubes 17*a*, 17*b*, and 17*c* is different from that of the supply tube 17*d*.

Meanwhile, the tube thickness of the supply tubes 17*a*, 17*b*, and 17*c* is also different from that of the supply tube 17*d* at the time of closing the tubes in the present embodiment. Accordingly, if a distance between the pressing portion 164*b* and the contact portion 163*d* is set to such a distance that can close the supply tube 17*d* having the larger thickness, the supply tubes 17*a*, 17*b*, and 17*c* having the smaller thickness are closed incompletely. On the other hand, if the distance between the pressing portion 164*a* and the contact portions 163*a*, 163*b*, and 163*c* is set to such a distance that can close the supply tubes 17*a*, 17*b*, and 17*c*, the reactive force of the supply tube 17*d* is significantly increased in the case where the supply tube 17*d* is closed. Given the situation, the receiving members 163 and the biasing members 170 to bias the receiving members 163 are configured to individually come into contact with and support the supply tubes 17*a*, 17*b*, 17*c*, and 17*d*, respectively. In this way, it is possible to provide the biasing forces required for the closure appropriately depending on the respective thicknesses of the tubes. Thus, a driving load of the cam 165 can be reduced in the case of closing the tubes without unnecessarily increasing the biasing forces.

FIG. 13 is a schematic cross-sectional view of the on-off valve mechanism 160, which illustrates the first pivot shaft 164*c* as well as the pressing portions 164*a* and 164*b* of the displacement member 164, and the second pivot shafts 163*e* and 163*h* of the receiving member 163. As shown in FIG. 12A, the tube outside diameter of the supply tubes 17*a*, 17*b*, and 17*c* is different from that of the supply tube 17*d*. The pressing portions 164*a* and 164*b* pivotally move about the first pivot shaft 164*c*. Accordingly, a separation distance La between the pressing portion 164*a* and the supply tubes 17*a*, 17*b*, and 17*c* is different from a separation distance Lb between the pressing portion 164*b* and the supply tube 17*d*, and La<Lb holds true. Distances from the first pivot shaft 164*c* of the displacement member 164 to the pressing portions 164*a* and 164*b* will be defined as distances Lm and Ln, respectively. In the present embodiment, the integrated displacement member 164 is independently provided with the pressing portions 164*a* and 164*b*, and is configured such that the distances to the first pivot shaft 164*c* of the displacement member 164 satisfy the Lm<Ln. In this way, it is possible to integrally close the supply tubes 17*a*, 17*b*, 17*c*, and 17*d* while ensuring the required separation distances depending on the respective outside diameters of the supply tubes 17.

As described above, it is possible to reduce the inclinations of the displacement member 164 and the receiving members 163 in the width direction of the tubes irrespective of the tube thicknesses or the dimensions of the components even in the case of integrally pressing the tubes, thereby suppressing the occurrence of an incompletely closed state of any of the tubes.

The description has been given of the example of the printing apparatus 100 of the resent embodiment which includes a plurality of the supply tubes 17. However, the present invention is also applicable to a printing apparatus that uses a single supply tube 17. Even in a case of using a tube having a large diameter, the configuration described in the present embodiment can suppress the occurrence of a leakage.

<Configurations of Cover Member 162 and Holding Member 169>

Next, a description will be given of configurations the cover member 162 and the holding member 169. In general, it is ideal for the on-off valve mechanism to be configured to press the tubes in the direction orthogonal to the direction of extension of the tubes. However, even in such a pressing structure, a force may be generated in the direction of extension of the tubes due to tolerances of the components and other factors, whereby the tube may move in the direction of extension thereof. The occurrence of the movement of the tubes may consume extra lengths of the tubes and the taut tubes may be disconnected from joint portions. On the other hand, the occurrence of the movement of the tube may increase the extra lengths of the tubes and the redundant tubes that are not properly housed in a designed space may cause buckling.

Meanwhile, in the on-off valve mechanism 160 described in the present embodiment, the displacement member 164 and the receiving member 163 are configured to be pivotally movable. A displacement of the pressing portion 164*a* or the contact portion 163*b* due to tolerances of the components may generate a force to be applied in the direction of extension of the tubes. Given the situation, the cover member 162 and the holding member 169 of the present embodiment are provided with a tube arrangement structure for suppressing the movement of the supply tubes 17 even in the case of generation of the force to be applied in the direction of extension of the supply tubes 17.

A description will be given below with reference to FIGS. 9A and 9B of an arrangement route for and a configuration of each supply tube 17 in the vicinity of the on-off valve mechanism 160. The holding member 169 includes a first tube regulating portion 169*b*, an opposed portion 169*c*, and a tube supporting portion 169*d*. The cover member 162 includes a second tube regulating portion 162*a*, an auxiliary contact surface 162*b*, and a third tube regulating portion 162*d*. These constituents collectively form an arrangement route for the supply tube 17.

The tube supporting portion 169*d* of the holding member 169 has such a shape that its tip end projects above the contact portion 163*a* in the case where the supply tube 17*a* is closed by the on-off valve mechanism 160. The tube supporting portion 169*d* supports the supply tube 17*a* in the vicinity of the pressing position P. A contact surface of the tube supporting portion 169*d* with the tube is provided within the width in y direction of the tube supporting portion 169*d*. In other words, the tube supporting portion 169*d* includes a substantially U-shaped groove portion and the supply tube 17*a* is arranged in the groove portion. As shown in FIG. 9B, a contact portion of the tube supporting portion 169*d* to come into contact with the tube is located substantially at the same height position in z direction (a vertical direction) as the pressing position P in the state where the tube is closed.

The first tube regulating portion 169*b* has such a shape that its tip end projects from the side supporting the supply tube 17*a* with the receiving member 163 to a position below the tube supporting portion 169*d*.

The second tube regulating portion 162*a* is provided at a position more distant from the pressing position P than the first tube regulating portion 169*b* is in terms of the direction of extension of the tube from the pressing position P. The second tube regulating portion 162*a* has such a shape that projects in an opposite direction (−z direction) to the direction of projection (+z direction) of the first tube regulating portion 169*b*. The second tube regulating portion 162*a* has such a shape that its tip end projects to a position below the tip end of the first tube regulating portion 169*b*. In other words, the first tube regulating portion 169*b* and the second tube regulating portion 162*a* have such shapes that their tip end portions project to a position where the tip end portions overlap each other in the direction of a projection axis (the vertical direction). The first tube regulating portion 169*b* and the second tube regulating portion 162*a* form a first clearance W1 that serves as the route for the supply tube 17*a*. The first tube regulating portion 169*b* and the second tube regulating portion 162*a* project from mutually opposite directions in a substantially orthogonal direction (z direction) to the direction of extension (x direction) at the pressing position P of the supply tube 17*a*, thus forming the arrangement route for bending the supply tube 17*a* into an S-shape. Meanwhile, the tip end of the second tube regulating portion 162*a* and the opposed portion 169*c* of the holding member 169 opposed to this tip end portion form a second clearance W2 that serves as the route for the supply tube 17*a*. The supply tube 17*a* passing through the second clearance W2 is arranged in an opposite direction (upward) from the near side to the opposed portion 169*c*, and is arranged not to fall off the cover member 162 by using the third tube regulating portion 162*d*. By regulating the supply tube 17*a* in x direction by using the third tube regulating portion 162*d*, the supply tube 17*a* is kept from spreading outside of the cover member 162 by the reactive force of the tube in the case the extra length of the tube is increased due to the tolerance and the like.

The supply tube 17*a* is arranged in the S-shape by using the first tube regulating portion 169*b* and the second tube regulating portion 162*a*. The tube reactive force of this supply tube 17*a* arranged in the S-shape is generated in a direction to bring the supply tube 17*a* into contact in such a way as to surround the tip end portion of the first tube regulating portion 169*b* or the second tube regulating portion 162*a*. Since this tube reactive force is constantly generated, the contact force with the first tube regulating portion 169*b* or the second tube regulating portion 162*a* is stably generated. Accordingly, even if the force is generated in the supply tube 17*a* in the direction of extension of the tube (x direction) from the pressing position P, a static frictional force against this force is generated so that the movement in the direction of extension of the tube can be suppressed.

To be more precise, if a force acts in a direction to drag the supply tube 17*a* to the pressing position P (−x direction), the contact force between a side surface portion of the first tube regulating portion 169*b* and the supply tube 17*a* is increased. Accordingly, the frictional force against the dragging force is increased so that the dragging movement of the supply tube 17*a* can be suppressed.

On the other hand, if a force acts in a direction to push the supply tube 17*a* from the pressing position P (+x direction), the contact force between a side surface portion of the second tube regulating portion 162*a* and the supply tube 17*a* is increased. Accordingly, the frictional force against the pushing force is increased so that the pushing movement of the supply tube 17*a* can be suppressed.

As described above, the direction of generation of the contact force with the tube regulating portion attributed to the tube reactive force is the substantially orthogonal direction to the direction of extension of the supply tube 17 from the pressing position P. Accordingly, even in case of the occurrence of the force to drag or push the supply tube 17*a*, the reduction in contact force of the supply tube 17*a* with the tube regulating member is small. Thus, it is possible to suppress the reduction in frictional force and to reduce the movement of the tube.

Meanwhile, the opposed portion 169*c* is provided in such a shape that blocks the direction of extension (which is z direction at this portion) of the supply tube 17*a* that is bent by the first tube regulating portion 169*b* and the second tube regulating portion 162*a*. In this way, even if the supply tube 17*a* is pushed toward the opposed portion 169*c*, the frictional force is increased along with the increase in contact force between the supply tube 17*a* and the opposed portion 169*c*, so that the movement of the tube can be reduced.

Moreover, the supply tube 17*a* is pressed against the contact portion of the tube supporting portion 169*d* at the time of the operation to close the tube, so that the contact force can be increased and the frictional force is increased as well. Thus, the movement of the supply tube 17*a* can be suppressed.

As described above, it is possible to suppress the movement of the supply tube 17*a* in the case where the tube is dragged to the pressing position P or in the case where the tube is pushed from the pressing position P.

In the arrangement route for the supply tube 17*a*, regions of the first tube regulating portion 169*b*, the tube supporting portion 169*d*, and the second tube regulating portion 162*a* which come into contact with and thus bend the supply tube 17*a* are preferably provided with arc forms. Since the supply tube 17*a* is bent along the arc shapes and the route is regulated accordingly, the contact area is effectively increased and an effect to suppress the movement of the tube is thus enhanced.

Meanwhile, in the present embodiment, the first clearance W1 is formed into such a width that the supply tube 17*a* bent into the S-shape comes into contact with the tube regulating portions with the reactive force of the tube. Here, the first clearance W1 may be set smaller than the outside diameter of the supply tube 17*a* to the extent that does not crush an inside diameter thereof. By pinching the supply tube 17*a* with the portion of the first clearance W1, it is possible to suppress the movement of the tube while reliably providing the frictional force to be applied between the supply tube 17*a* and the tube regulating portions 162*a* and 169*b*.

In the present embodiment, the second clearance W2 is formed into such a width that the supply tube 17*a* comes into contact with the opposed portion 169*c* with the reactive force of the tube. Here, the second clearance W2 may be set smaller than the outside diameter of the supply tube 17*a* to the extent that does not crush the inside diameter thereof. By pinching the supply tube 17*a* with the portion of the second clearance W2, it is possible to suppress the movement of the tube while reliably providing the frictional force to be applied between the supply tube 17*a* and the tube regulating portions 162*a* and 169*b*.

The on-off valve mechanism 160 of the present embodiment is configured to open and close the supply tubes 17 by bringing the pivotally movable displacement member 164 into contact with the receiving members 163. However, the movement of the tubes in the direction of extension thereof can be suppressed without limitations to this configuration. Specifically, an on-off valve mechanism that closes tubes by linear movement can also suppress the movement of the tubes in the direction of extension thereof by adopting the above-described configuration that uses the cover member 162 and the holding member 169.

Meanwhile, the supply tube 17*a* passing through the second clearance W2 is arranged in an opposite direction to the near side of the opposed portion 169*c* via the auxiliary contact surface 162*b*, so as to reduce a curvature radius of the bent portion of the supply tube 17*a*. Thus, it is possible to further suppress the movement of the tube by increasing the contact force between the supply tube 17*a* and the tube regulating portions attributed to the tube reactive force. The auxiliary contact surface 162*b* is formed into a curved surface portion having an arc shape with such a curvature radius that keeps a portion of the supply tube 17*a* around the second tube regulating portion 162*a* from buckling. Moreover, the supply tube 17*a* is arranged on an upper part of the cover member 162 with its movement in x direction being regulated by the third tube regulating portion 162*d*.

As described above, according to the present embodiment, the displacement member 164 configured to press the tubes can press the tubes in parallel along the widths of the tubes in the case of pressing the tube having the large diameter or in the case of integrally pressing the plurality of the tubes. In other words, the displacement member 164 is configured to be pivotally movable about the first pivot shaft 164*c*, and the receiving member 163 to hold the supply tube 17*a* is also configured to be pivotally movable about the second pivot shafts 163*e* and 163*h*. Moreover, the direction of extension of the pivot shafts are configured to extend in an intersecting direction (the width direction of the tubes) that intersects with the direction of the extension of the tubes. For this reason, even if the tubes are integrally pressed, for example, it is possible to reduce the inclinations of the displacement member 164 and the receiving members 163 in the width direction of the tubes irrespective of the tube outside diameters and the tube thicknesses as well as the dimensions of the components. As a consequence, it is possible to suppress a leakage in the case of pressing the tubes.

Meanwhile, in the present embodiment, even in the case where the supply tube 17 receives the force in the direction of extension thereof at the position to press the tube due to the opening and closing operations by the on-off valve mechanism 160, the tube route is regulated such that the frictional force is stably generated against that force. Accordingly, it is possible to suppress the movement of the supply tube 17 even if the opening and closing operations are carried out by the on-off valve mechanism 160.

Other Embodiments

The above-described embodiment has explained the example in which the displacement member 164 presses the supply tubes 17. However, the present embodiment is applicable to any other modes as long as it is a mode in which a flow channel is closed by pressing a tube with a pressing portion. For instance, the present invention is also applicable to a mode of using a pressing portion to press a tube that is connected to a pump to be used at the time of a recovery operation. In other words, the valve mechanism described in the present embodiment is applicable to tubes for various flow channels.

Meanwhile, the above-described embodiment has explained the example of the printing apparatus that performs printing by using the inks. Instead, the present invention may be applied to a flow channel opening/closing apparatus to open and close a flow channel for circulating a liquid or a gas, which includes the above-described on-off valve mechanism. Of course, the present invention is applicable to a printing apparatus that includes such a flow channel opening/closing apparatus (a flow channel opening/closing mechanism).

In the meantime, the above-described embodiment has explained the example in which the receiving member 163 is biased by the biasing member 170 in the direction to come close to the displacement member 164. However, the present invention is not limited only to this example. The same effects as those of the above-described embodiment can also be obtained from a configuration in which one of the receiving member 163 and the displacement member 164 is biased in a direction to come close to each other. In other words, the displacement member 164 does not have to be biased in the direction to come close to the receiving member 163 by the not-illustrated biasing member, and the displacement member 164 may instead be biased in a direction to come close to the receiving member 163 by another not-illustrated biasing member in a direction toward the cam 165. In this case as well, the displacement member 164 can move to the position to press and close the tube and to the position to recede from and open the tube with the cam 165 as described above. In this example, the receiving member 163 may be biased by the biasing member 170 in the direction to come close to the displacement member 164 likewise. Alternatively, the receiving member 163 may be fixed to the holding member 169.

Meanwhile, the above-described embodiment has explained the example of providing the tube arrangement route by using the holding member 169 and the cover member 162. Instead of using the separate members, the similar tube arrangement route may be provided by a single member. In the meantime, the above-described embodiment has explained the example in which the plurality of tubes are provided and the tube regulating portions project from mutually opposite directions in terms of the height direction. However, the present invention is not limited only to this configuration. In a case where the number of tubes is small, for example, the tube regulating portions may have such shapes that project from mutually opposite directions in terms of the width direction intersecting with (for example, being orthogonal to) the direction of extension of the tubes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-020361, filed Feb. 12, 2021, which is hereby incorporated by reference wherein in its entirety.

What is claimed is:

1. A printing apparatus comprising:

a first tube configured to form a flow channel to supply a liquid to a liquid ejecting unit configured to eject the liquid;

a second tube configured to form a flow channel to supply a liquid to a liquid ejecting unit configured to eject the liquid;

a holding unit configured to hold the first tube and the second tube, wherein the holding unit includes a first auxiliary supporting portion configured to regulate movement in a width direction of the first tube and includes a second auxiliary supporting portion configured to regulate movement in a width direction of the second tube; and a valve unit configured to close the first tube and the second tube at a closed position by pressing the first tube and the second tube with a pressing portion, and to open the first tube and the second tube at an open position, wherein the valve unit is pivotally movable about a pivot shaft from the open position to the closed position, and a direction of extension of the pivot shaft is a direction intersecting with a direction of extension of the tube held by the holding unit.

2. The printing apparatus according to claim 1, wherein the pressing portion includes a first pressing portion and a second pressing portion, and wherein the first pressing portion presses the first tube in the closed position, and the second pressing portion presses the second tube in the closed position, and wherein a distance between the first pressing portion and the pivot shaft in a first direction intersecting with an axial direction of the pivot shaft is smaller than a distance between the second pressing portion and the pivot shaft in the first direction.

3. The printing apparatus according to claim 2, further comprising:

biasing units configured to bias so as to cause the valve unit and the holding unit to come close relatively, wherein the holding units are provided to the respective tubes, and the biasing units are provided to the respective holding units in such a way as to bias so that the holding units and the valve unit come to close relatively.

4. The printing apparatus according to claim 2, wherein a thickness of the second tube is larger than a thickness of the first tube.

5. The printing apparatus according to claim 2, wherein an outside diameter of the second tube is larger than an outside diameter of the first tube.

6. The printing apparatus according to claim 1, wherein the holding unit is pivotally movable with pivot shafts independently provided for the tubes.

7. The printing apparatus according to claim 1, wherein the holding unit includes a contact portion located at a position opposed to the pressing portion at the closed position and configured to come into contact with the tubes, and the pivot shaft of the valve unit is located substantially at an equal height to the contact portion of the holding unit.

8. The printing apparatus according to claim 1, wherein each of the first auxiliary supporting portion and the second auxiliary supporting portion is provided at a position to be able to come into contact with the valve unit in a case where the valve unit is located at the closed position, and in a state where the valve unit is located at the closed position, the pressing portion presses the tubes, and a clearance is formed between the valve unit and each of the auxiliary supporting portions.

9. The printing apparatus according to claim 8, wherein the auxiliary supporting portions are is not opposed to the pressing portion in a state where the valve unit is located at the closed position.

10. A printing apparatus comprising:

a tube configured to form a flow channel to supply a liquid to a liquid ejecting unit configured to eject the liquid;

a valve unit configured to move to a closed position to press to close the tube and to an open position not to close the tube; and a first tube regulating portion and a second tube regulating portion projecting in mutually opposite directions in an intersecting direction intersecting with a direction of extension of the tube, wherein a position of tip end portion of the first tube regulating portion and a position of part of the second tube regulating portion overlap each other in the intersecting direction, the first tube regulating portion and the second tube regulating portion form a first clearance in the direction of extension, and the tube is arranged to pass through the first clearance.

11. The printing apparatus according to claim 10, further comprising:

an opposed portion located more distant from a pressing position where the tube is pressed by the valve unit than the first tube regulating portion is, and opposed to the tip end portion of the second tube regulating portion, a tip end portion of the second tube regulating portion and the opposed portion form a second clearance in the intersecting direction, and the tube is arranged to pass through the second clearance.

12. The printing apparatus according to claim 11, wherein the second tube regulating portion includes a curved surface portion located on an opposite side of a side to form the first clearance, and the tube passing through the second clearance is arranged to pass through the curved surface portion and to be regulated by a third tube regulating portion configured to regulate the tube.

13. The printing apparatus according to claim 11, further comprising:

a tube supporting portion configured to support the tube between the pressing position to the first tube regulating portion; and a contact portion opposed to the valve unit at the pressing position, wherein the tube supporting portion projects beyond the contact portion in the intersecting direction.

14. The printing apparatus according to claim 11, wherein the first clearance is smaller than an outside diameter of the tube.

15. The printing apparatus according to claim 11, wherein the second clearance is smaller than an outside diameter of the tube.

16. The printing apparatus according to claim 11, wherein the intersecting direction is a vertical direction.

* * * * *